US006712635B1

(12) United States Patent
Nimura

(10) Patent No.: US 6,712,635 B1
(45) Date of Patent: Mar. 30, 2004

(54) CONNECTOR

(75) Inventor: Kazuhiko Nimura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/621,278

(22) Filed: Jul. 17, 2003

(30) Foreign Application Priority Data

Jul. 17, 2002 (JP) ..... 2002-208679
Apr. 21, 2003 (JP) ..... 2003-115919

(51) Int. Cl.[7] ..... H01R 13/627
(52) U.S. Cl. ..... 439/352; 439/489
(58) Field of Search ..... 439/352, 489, 439/488, 353, 354, 355, 356, 357, 358, 345, 347, 350

(56) References Cited

U.S. PATENT DOCUMENTS 5,120,255 A 6/1992 Kouda et al.
6,022,238 A * 2/2000 Tomita et al. ..... 439/352
6,572,400 B2 * 6/2003 Noguchi et al. ..... 439/489

* cited by examiner

*Primary Examiner*—Tho D. Ta
*Assistant Examiner*—James R. Harvey
(74) *Attorney, Agent, or Firm*—Anthony J. Casella; Gerald E. Hespos

(57) ABSTRACT

A resilient locking piece (58) projects from a detector (50). When male and female housings (10, 20) are connected, a lock arm (30) is inclined and the engaging portions (38) return the detector (50). In this state, the detector (50) cannot be pushed in, with the result that a partial connection can be detected. When the connectors (10, 20) are connected property, the lock arm (30) returns to engage an engageable portion (35) with a lock (15) from behind. At this time, a head (59) of the resilient locking piece (58) is opposed to a slanted guiding surface (15B) of the lock (15). Accordingly, the detector (50) is pushed in and reaches a detecting position while the resilient locking piece (58) is guided by the guiding surface (15B) and deformed. In this way, proper connection of the housings (10, 20) is detected.

9 Claims, 22 Drawing Sheets

CONNECTOR

BACKGROUND OF THE INVENTION

1. Field of the Invention

The invention relates to a connector with a connection detecting function.

2. Description of the Related Art

U.S. Pat. No. 5,120,255 and FIG. 22(A) herein show a connector with a connection detecting function. With reference to FIG. 22(A), the connector has first and second housings 1 and 2. A resiliently inclinable lock arm 3 is provided on the first housing 1 and has an engageable portion 3A that engages a lock 4 on the second housing 2 when the housings 1, 2 are connected properly. A detector 5 is detachably mountable along the lock arm 3 and has a resiliently deformable detecting arm 6. A stopper 7 is provided at the leading end of the detecting arm 6 for contacting and receiving the engageable portion 3A of the lock arm 3.

The lock arm 3 and the stopper 7 pass the lock 4 during connection of the housings 1, 2, and resiliently deform the detecting arm 6. The detector 5 may be pushed in during this connection. However, such a pushing movement is hindered by contact of the stopper 7 with the engageable portion 3A. As a result, the two housings 1, 2 are detected to have been left partly connected. On the other hand, the engageable portion 3A engages the lock 4 when the housings 1, 2 are connected properly to lock the housings 1, 2 together, and the lock arm 3 makes a returning movement. Thus, the engageable portion 3A is disengaged from the stopper 7, and the detector 5 can be pushed in. As a result, proper connection of the housings 1, 2 can be detected.

However, in the prior art connector, the detecting arm 6 inevitably is deformed resiliently when the detector 5 is pushed to detect the connected state. The detecting arm 6 also is deformed resiliently as the lock arm 3 is inclined during the connecting operation of the two housings 1, 2. Thus, an extra time is taken for the resilient deformation of the detecting arm 6, thereby presenting a problem of poor durability resulting from an excessive load exerted on a supporting point of deformation.

The present invention was developed in view of the above problem and an object thereof is to improve the durability of a detecting member.

SUMMARY OF THE INVENTION

The invention relates to a connector with first and second housings that are connectable with each other. The first housing has a lock arm and the second housing has a lock engageable with an engageable portion of the lock arm. The lock arm is deflected resiliently as the two housings are being connected. However, the lock arm returns resiliently when the housings reach their properly connected state, and the engageable portion of the lock arm engages the lock to lock the housings together. A detector is detachably mountable into the first housing to detect a connected state of the two housings based on whether the detector can be pushed from a standby position toward a detecting position. The detector comprises a resilient locking piece that is opposed to the engageable portion of the lock arm at its initial position before the two housings are connected and at an initial stage of connection of the two housings. Thus, the resilient locking piece prevents the detector from being pushed in a mounting direction. At least one contact means is provided for preventing the detector from being pushed in by being substantially opposed to the lock arm that has been inclined during the connection of the two housings.

Contact of the resilient locking piece with the engageable portion of the lock arm prevents the detector from being pushed in the mounting direction from the standby position until the housings are connected. The lock arm is inclined during the connection of the housings. A pushing force on the detector in the mounting direction during connection is hindered by contact of the contact means while the lock arm is inclined. As a result, the partial connection of the housings can be detected. On the other hand, the housings may be, connected properly. In this situation, the engageable portion of the lock arm engages the lock as the lock arm returns, and the guiding surface of the lock is substantially opposed to the resilient locking piece. As a result, the resilient locking piece contacts the guiding surface and permits the detector to be pushed in the mounting direction while being resiliently deformed along the guiding surface. As a result, proper connection of the housings can be detected.

The resilient locking piece of the detector preferably is constructed to be deformed resiliently only when the detector is pushed in to detect the connected state. Thus, an excessive load on a supporting point of deformation and the like can be avoided, and durability can be improved.

The lock preferably has a guiding surface that is opposed to the resilient locking piece when the lock arm returns. The guiding surface deforms the resilient locking piece when the detector is pushed in the mounting direction.

The lock arm is inclined as the two housings are connected and engages a cam surface of the contact means. Accordingly, the detector is moved back from the push-preventing position to the standby position. Thus, the detector can be pushed with a large stroke, making the connection detection more distinct.

The first housing preferably has a return-preventing portion and the detector preferably has a deformation-preventing piece. The deformation-preventing piece and the return-preventing portion contact while the detector is held at the push-preventing position by the resilient locking piece and the engageable portion. Thus, the detector cannot move toward the standby position, and the deformation-preventing piece is disengaged from the return-preventing portion while being deformed by the engagement with the lock arm that has been inclined in the process of connecting the two housings. As a result, backward movement of the detector toward the standby position is permitted.

The detector is moved back from the push-preventing position where, the resilient locking piece and the engageable portion hold the detector, to the standby position while the lock arm is inclined as the housings are connected. The detector could shake in forward and backward directions if the detector at the push-preventing position could be moved freely back toward the standby position when the two connectors are partly connected. However, the engagement of the deformation-preventing piece and the return-preventing portion prevents the detector from moving from the push-preventing position to the standby position, and hence prevents loose shaking movements in forward and backward directions. Thus, the detector is held securely at the push-preventing position.

The contact means preferably comprises a deformation-preventing piece and a contact portion formed on the first housing. The detector may be pushed in a partly connected state of the two housings where the lock arm is inclined. However, the deformation-preventing piece that is pushed by the lock arm contacts the contact that is prevented from undergoing a resilient deformation and prevents the detector from being pushed.

The deformation-preventing piece engages the lock arm that is inclined after the deformation-preventing piece disengages from the return-preventing portion. Thus the deformation-preventing piece functions as the contact means for preventing the detector from being pushed in the mounting direction while the lock arm is inclined. However, the deformation-preventing piece is resiliently deformable, and may not function well as a stopper for preventing the detector from being pushed in the mounting direction. However, the deformation-preventing piece is brought into contact with the contact portion to prevent the resilient deformation of the deformation-preventing piece. Hence, the deformation-preventing piece can function as the stopper.

The detector preferably has a restricting surface for slipping under an operable portion used to incline the lock arm, thereby preventing the lock arm from being inclined, deflected or deformed, when the detector is pushed to the detecting position. Thus, the lock arm cannot be inclined inadvertently to effect unlocking, and double locking is achieved.

At least one lock arm contact portion is provided to prevent the lock arm from being deflected, when the detector is in the detecting position.

Preferably, the detector is provided with a semi-locking construction for allowing the detector to be returned in a direction substantially opposite to the mounting direction toward the standby position or a position near the standby position when a force larger than a specified force is applied thereto.

Loose movement restricting means preferably are provided for restricting loose transverse movements of the detector with respect to the first housing.

Most preferably, when the detector is pushed in the mounting direction to the detecting position, the rear end surface thereof is substantially flush with the rear end surface of the female housing.

These and other features and advantages of the invention will be more apparent upon reading the detailed description of preferred embodiments and accompanying drawings. Even though embodiments are described separately, single features may be combined to additional embodiments.

DETAILED DESCRIPTION OF THE PREFERRED EMBODIMENTS

A connector according to a first embodiment of the invention is shown in FIGS. 1 to 9, and is comprised of a male housing 10 and a female housing 20 that are connectable with each other along an inserting direction ID. In the following, a mating side of the female housing 20 with the male housing 10 is referred to as the front and a forward and backward or longitudinal direction substantially corresponds to the inserting direction ID.

The male housing 10 is made e.g. of a synthetic resin and is in the form of a wide receptacle that projects unitarily from an outer wall of a piece of equipment. Tab-shaped male terminals 11 connected with a printed circuit board or the like provided in the equipment project from the back surface of the male housing 10 while being substantially aligned in upper and lower rows.

Figure 1:
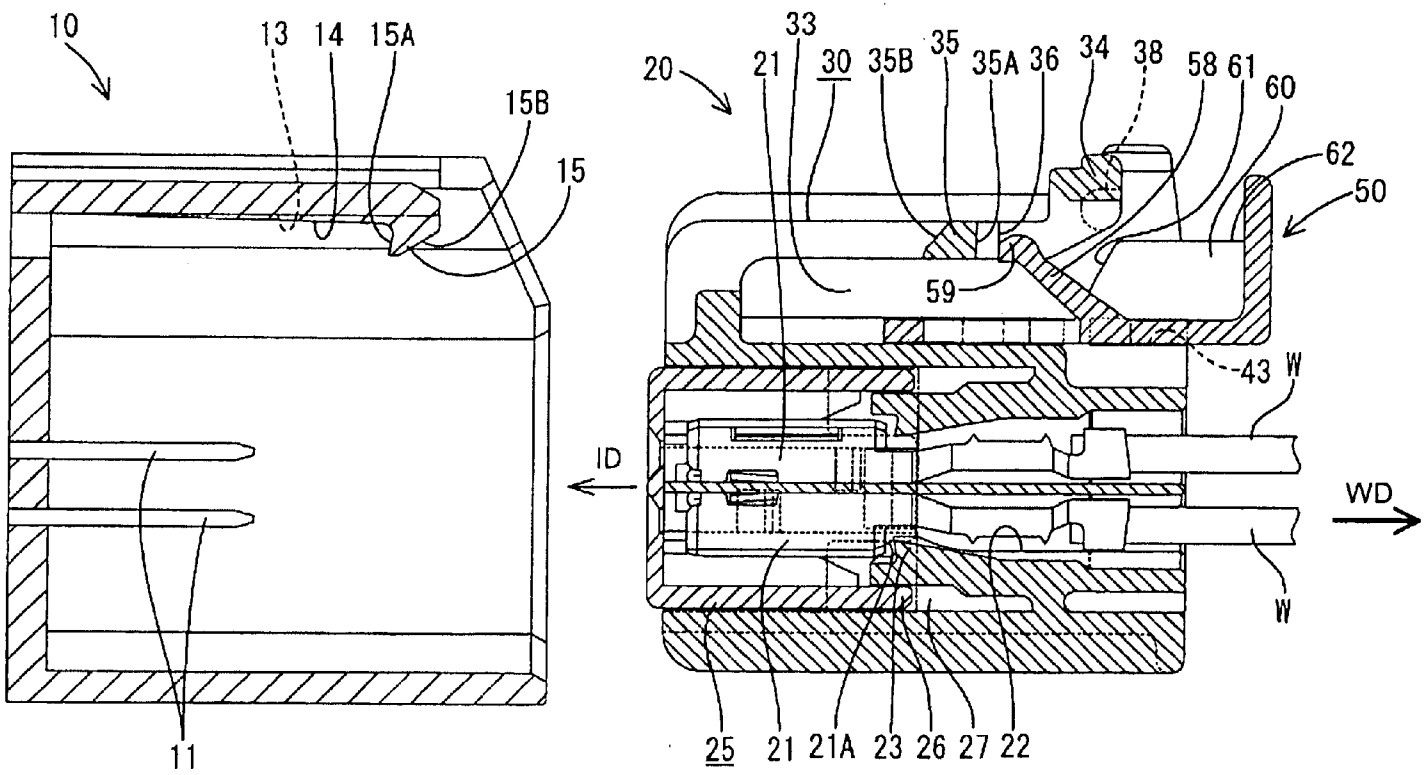
FIG. 1 is a longitudinal section showing a state before a male and a female housings according to one embodiment of the present invention are connected.

The female housing 20 also is made e.g. of a synthetic resin and is substantially in the form of a block that is fittable into the male housing 10. Female terminals 21 are secured to ends of wires W and are inserted into cavities 22 formed in the female housing 20. The cavities 22 are disposed at two stages in the female housing 20 and correspond to the alignment of the male terminals 11, as shown in FIG. 1. A partial locking portion 23 is provided on a ceiling or bottom surface of each cavity 22.

A retainer 25 is mountable to the front surface of the female housing 20 for doubly locking the female terminals 21 in the corresponding cavities 22. The retainer 25 is mounted initially at a partial locking position shown in FIG.

3, where intruding portions 26 at the upper and lower edges of the retainer 25 are spaced before deformation spaces 27 for the locking portions 23. The female terminals 21 are inserted into the corresponding cavities 22 with the retainer 25 at the partial locking position and are pushed to deform the locking portion 23 toward the deformation space 27. The locking portion 23 is restored resiliently when the female terminal 21 reaches a proper position and engages a jaw 21A to partly lock the female terminal 21 (see FIG. 1). The retainer 25 is pushed from the partial locking position to a full locking position shown in FIG. 1 after all of the female terminal fittings 21 have been inserted. Thus, the intruding portions 26 enter the deformation spaces 27 to prevent the locking portions 23 from deforming. As a result, the female terminals 21 indirectly are locked doubly with respect to the withdrawing direction WD.

Figure 4:
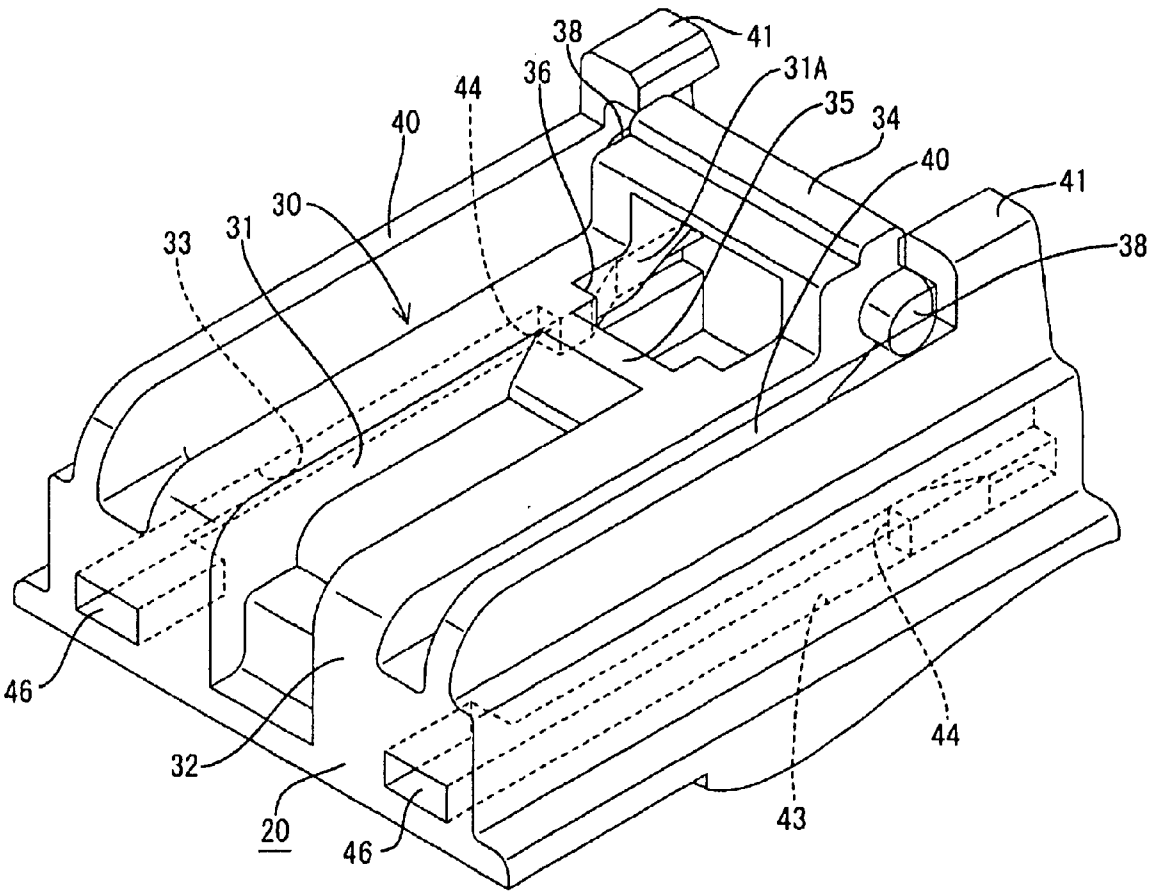
FIG. 4 is a partial perspective view showing a construction near a lock arm.

A lock arm 30 is formed unitarily on the upper surface of the female housing 20 for locking the female housing 20 and the mating male housing 10 in their properly connected state. As shown in FIG. 4, the lock arm 30 projects out substantially from a widthwise middle of the front edge of the upper surface of the female housing 20 and then extends back substantially along the inserting direction ID. The lock arm 30 is divided to define a groove 31 between two forked sections. An extending end of the lock arm 30 is inclinable toward a displacement space 33 defined below with the upwardly extending portion thereof at the front end as a support 32. The forked sections of the lock arm 30 project out at their extending ends, which are coupled to each other to form an operable portion 34 used to forcibly incline the lock arm 30.

An engageable portion 35 is formed in the groove 31 near the extending end of the lock arm 30. A locking surface 35A is formed on the engageable portion 35 and faces toward the extending end of the lock arm 30. The locking surface 35A is substantially perpendicular to the inserting direction ID. A slanted guiding surface 35B is defined on the face of the engageable portion 35 opposite the locking surface 35A. A widened portion 31A with a stepped section 36 is formed in an area of the groove 31 slightly behind the locking surface 35A of the engaging portion 35 as seen in the inserting direction ID and opens in the extending end of the lock arm 30. Engaging portions 38 substantially rounded towards the front side or in the form of a short cylinders project from the opposite outer surfaces of the operable portion 34 (see e.g. FIG. 4).

Left and right protection walls 40 extend longitudinally at the left and right sides of the lock arm 30, and are spaced apart by a specified distance. Opposed hooked pressing portions 41 are formed on the upper surfaces of the rear ends of the protection walls 40 for restricting upward movements of the engaging portions 38 of the lock arm 30. The pressing portions 41 prevent the lock arm 30 from being inclined excessively in an upward direction.

A slide-contact surface 13 is formed on the ceiling of the mating male housing 10 for sliding contact with the upper surface of the lock arm 30 when the lock arm 30 is in a natural state. An elongated projection 14 is formed at a position on the slide-contact surface 13 substantially corresponding to the groove 31 of the lock arm 30 and has substantially the same width as the groove 31. The elongated projection slopes gradually down toward its free end. A lock 15 projects down at the leading end of the elongated projection 14 and is engageable with the engageable portion 35 of the lock arm 30. The rear surface of the lock 15 is an undercut locking surface 15A while the front surface thereof is a slanted guiding surface 15B.

The guiding surfaces 35B, 15B of the engageable portion 35 of the lock arm 30 and the lock 15 contact each other while the female housing 20 is being fit into the male housing 10 in the inserting direction ID. The lock arm 30 deflects inward substantially normal to the inserting direction ID as the female housing 20 is pushed in (see FIG. 6). The engageable portion 35 passes the lock 15 when the female housing 20 is pushed substantially to a proper position. Thus, the lock arm 30 returns and the engageable portion 35 engages the lock 15 from behind as seen in the inserting direction ID (see FIG. 8). As a result, the two housings 10, 20 are locked in their connected state.

Figure 5:
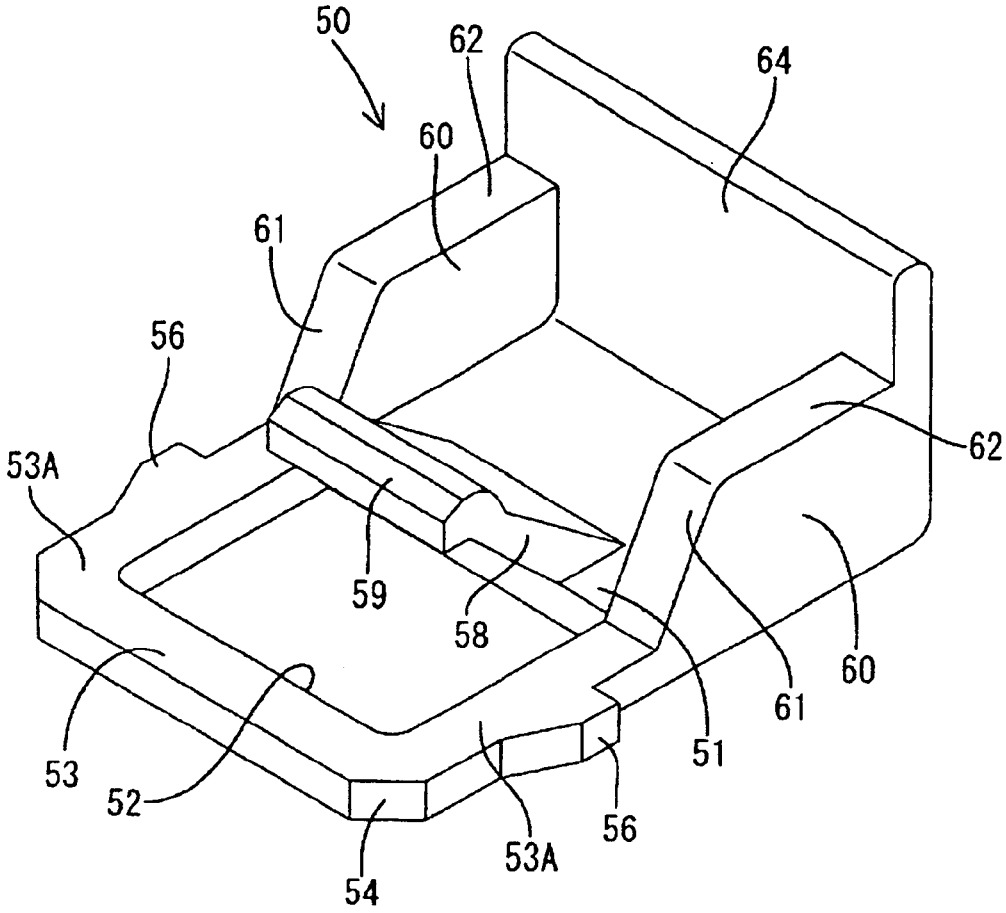
FIG. 5 is a perspective view of a detecting member.

A detector 50 formed e.g. of a synthetic resin is mountable in the displacement space 33 of the lock arm 30 for detecting the connected state of the housings 10, 20. The detector 50, as shown in FIG. 5, has a base plate 51 that is narrow and long in the longitudinal direction and has a width substantially equal to the lateral dimension of the displacement space 33. A window hole 52 is formed in a front part of the base plate 51, and hence defines a frame 53 on the base plate 51. Chamfered surfaces 54 are formed at both front corners of the frame 53 and projections 56 are formed substantially transversely symmetrically on the outer surfaces of left and right frame sections 53A. The rear surfaces of the projections 56 are locking surfaces that are perpendicular to the longitudinal direction, while the front surfaces are slanted.

Guide grooves 43 are formed at the bottom sides of the left and right inner walls of the displacement space 33 and extend longitudinally substantially parallel to a mounting direction MD of the detector 50 to the female housing 20, as shown in FIG. 4. The guide grooves 43 slidably receive the projections 56. Accordingly, the detector 50 is detachably mountable in the mounting direction MD along the bottom surface of the displacement space 33 while the projections 56 fit into and are guided by the guide grooves 43. Stopper protrusions 44 are formed near the rear ends of the guide grooves 43 for engaging the projections 56 of the detector 50. The front surfaces of the stopper protrusions 44 are substantially perpendicular to the mounting direction MD, while the rear surfaces thereof are slanted.

A resilient locking piece 58 projects from the rear edge of the window hole 52 on the base plate 51 of the detector 50. This resilient locking piece 58 has a width to fit into the widened portion 31A of the groove 31 of the lock arm 30 and extends obliquely out and up to the front in the mounting direction MD. A semicircular head is defined at the leading end of the resilient locking piece 58, and is usually at a height to face the widened portion 31A of the groove 31 of the lock arm 30 in its natural state (see FIG. 1). The head 59 of the resilient locking piece 58 contacts the stepped portion 36 of the groove 31 of the lock arm 30 to prevent the detector 50 from being pushed any further.

Figure 2:
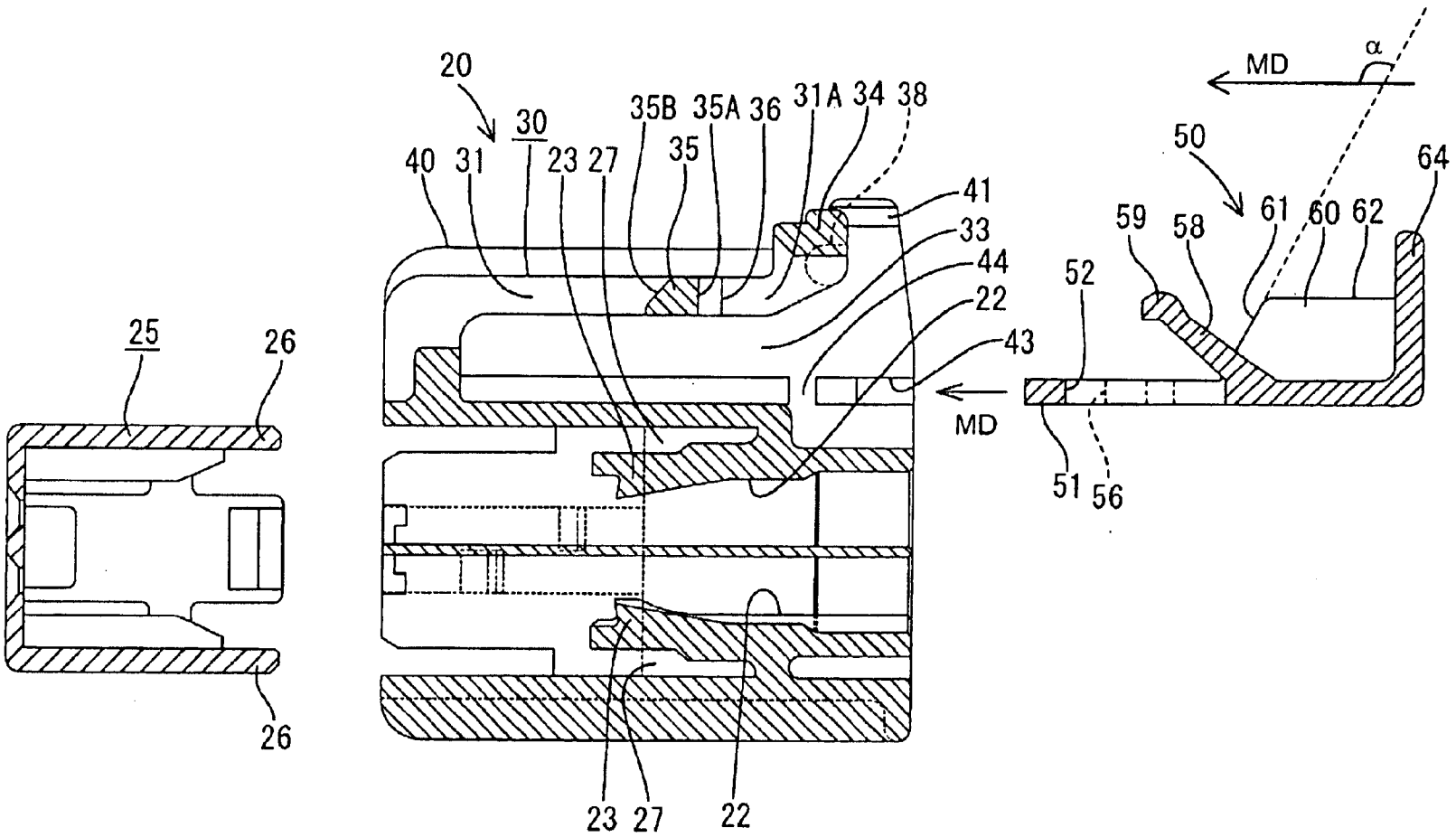
FIG. 2 is an exploded longitudinal section of the female housing.

Contact walls 60 extend at the left and right edges of a rear area of the base plate 51 of the detector 50 and are slightly shorter than the resilient locking piece 58. Cam surfaces 61 are formed at the front of the contact walls 60 and slope steeply down to the front towards the base plate. The engaging portions 38 projecting from the opposite outer surfaces of the operable portion 34 are engageable with the cam surfaces 61 when the lock arm 30 is inclined. The cam surfaces 61 are arranged at an angle cc that preferably is between about 90° to 130° with respect to the mounting direction MD (FIG. 2). Restricting surfaces 62 are defined at the upper edges of the contact walls 60 and contact the engaging portions 38 to prevent the operable portion 34 from being pushed down. The restricting surfaces 62 may be arranged at a small angle (e.g. less than about 10°) to the mounting direction MD, but most preferably are substantially parallel thereto.

Insertion openings 46 are formed in the front of the female housing 20 and communicate with the front ends of the guide grooves 43. The insertion openings 46 can receive a jig for forcibly deforming the frame sections 53A of the detector 50. A tall rear wall 64 extends at the rear end of the base plate 51 of the detector 50 and can receive fingers to push or return the detector 50. The rear wall 64 projects from the base plate 61 more than the cam surfaces 61.

The detector 50 is mounted in the female housing 20 by aligning the left and right projections 56 with the guide grooves 43 and then pushing the detector 50 in the mounting direction MD along the bottom surface of the displacement space 33, as indicated by an arrow in FIG. 2. The projections 56 contact the stopper protrusions 44 in the guide grooves 43 at an intermediate stage of the insertion. Further pushing of the detector 50 causes the left and right frame sections 53A to deform inward so that the projections 56 can pass the stopper projections 44. The frame sections 53A then are restored substantially to their original shape to fit the projections 56 again into the guide grooves 43. The detector 50 then is pushed further in the mounting direction MD until the head 59 of the resilient locking piece 58 contacts the stepped portion 36 of the groove 31 of the lock arm 30. This position is referred to as a mount position of the detector 50.

Figure 3:
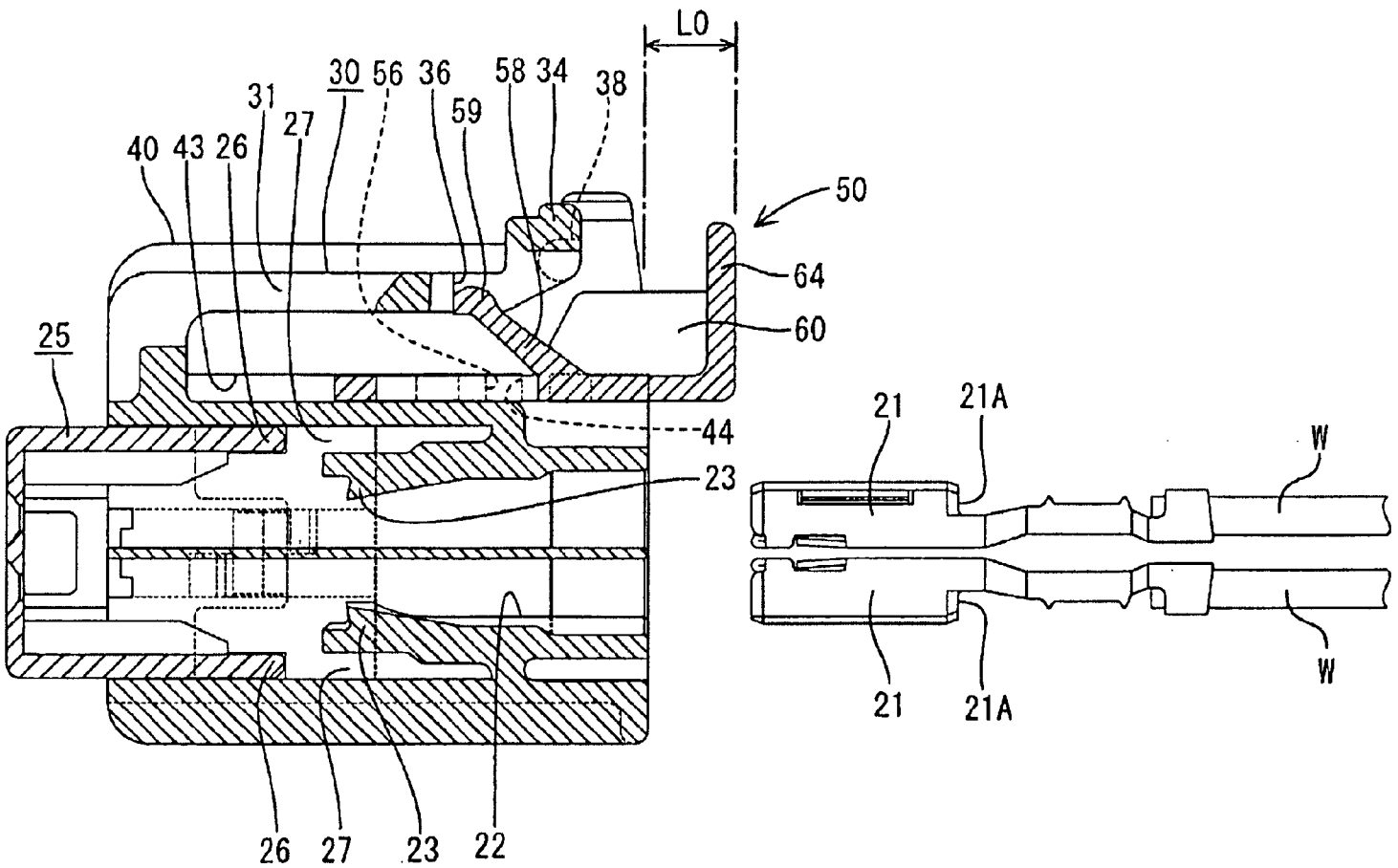
FIG. 3 is a longitudinal section showing a state before female terminals are inserted into the female housing.

The female terminals 21 are inserted into the corresponding cavities 22 with the retainer 25 at the partial locking position and are locked partly by the locking portions 23 (see FIG. 3). The retainer 25 then is pushed to the full locking position shown in FIG. 1 to lock the female terminals 21 doubly.

Figure 6:
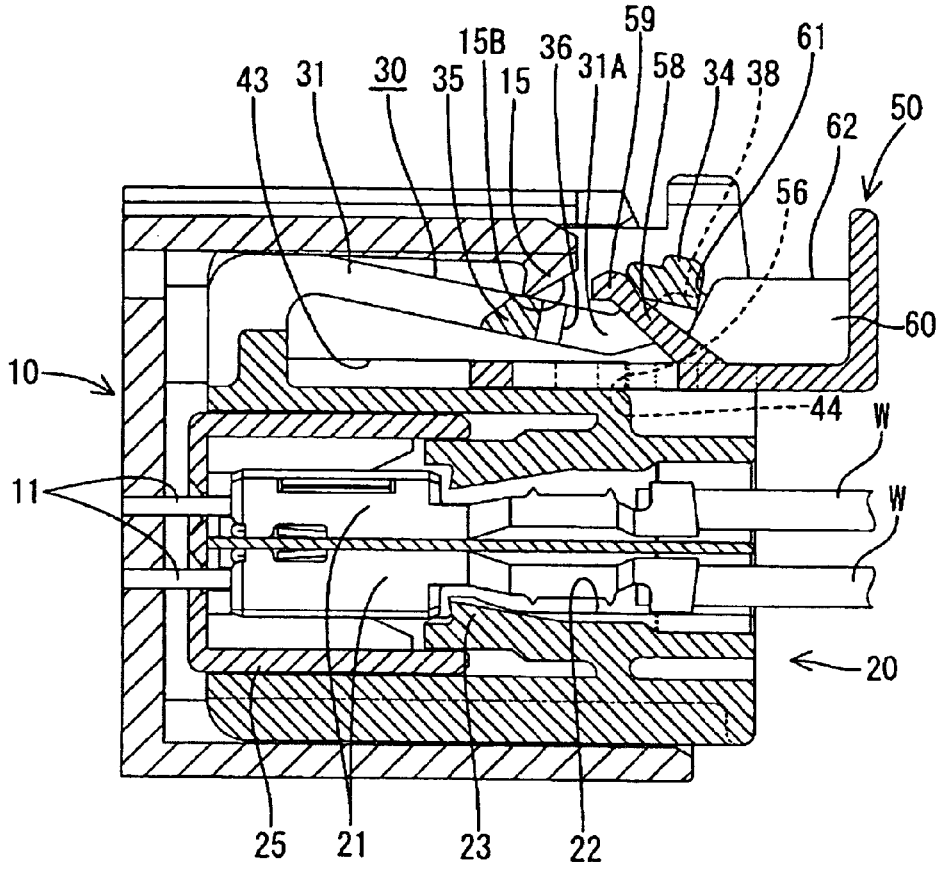
FIG. 6 is a longitudinal section showing an intermediate stage of connection of the two housings.
Figure 7:
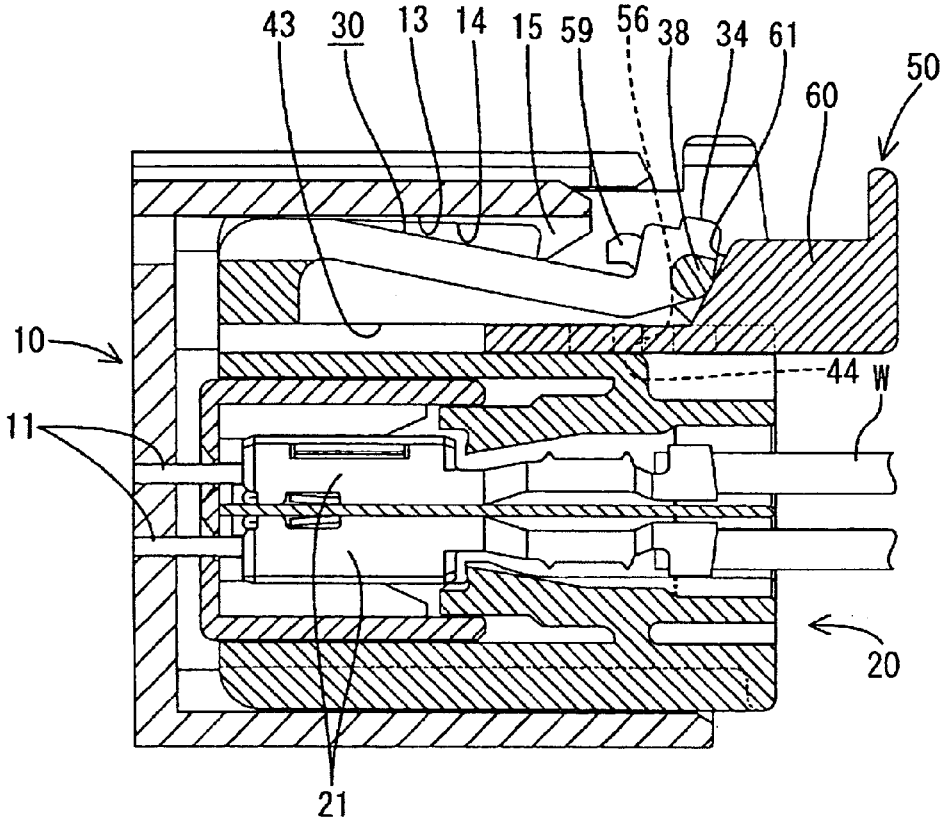
FIG. 7 is a longitudinal section showing a returning movement of the detecting member.

The female housing 20 then is fitted in the inserting direction ID into the male housing 10 as indicated by an arrow in FIG. 1. As the connection proceeds, the guiding surfaces 35B of the engageable portion 35 of the lock arm 30 contact the guiding surfaces 15B of the lock 15. Thus, the lock arm 30 is pushed and inclined. The engageable portion 35 moves over the lock 15, as shown in FIG. 6, toward a final stage of the connection, and preferably when at least about 60% of the connection stroke is achieved. The engaging portions 38 of the inclined lock arm 30 press the cam surfaces 61 of the contact wall 60 of the detector 50, as shown in FIG. 7, and move the detector 50 back in a direction opposite to the mounting direction MD along the guide grooves 43.

The male and female terminals 11, 21 are connected deeply and cause a considerable resistance as the connecting operation of the two housings 10, 20 approaches the final stage. Thus, an operator may mistakenly assume that the two housings 10, 20 have been connected properly and may stop the connecting operation. In such a case, a pushing force on the detector 50 in the moving direction MD causes the cam surfaces 61 of the contact walls 60 to push the engaging portions 38 of the lock arm 30 as shown in FIG. 7. However, as shown in FIG. 6, the engageable portion 35 slips under the lock 15, and the interaction of the cam surface 61 and the engaging portions 38 cannot deflect the lock arm 30 back to its initial position. Thus, the lock arm 30 is fixed, and the detector 50 cannot be pushed in. As a result, partial connection of the two housings 10, 20 can be detected.

The engageable portion 35 passes the lock 15 when the female housing 20 is pushed to the proper position. Thus, the lock arm 30 can return toward its initial position, and the engageable portion 35 engages the lock 15 from behind to lock the housings 10, 20 in the connected state shown in FIG. 8. Simultaneously, the engaging portions 38 push the cam surfaces 61 and move the detector 50 further back, and the engagement of the projections 56 with the stopper protrusions 44 lock the detector 50 so as not to come out. This position is referred to as a standby position of the detector 50 where the detector 50 is away from the mount position (see FIG. 3) by a distance L=L1 −L0.

The head 59 of the resilient locking piece 58 is opposed to the slanted guiding surface 15B of the lock 15 immediately before the head 59 when the detector 50 is moved back to the standby position.

Figure 9:
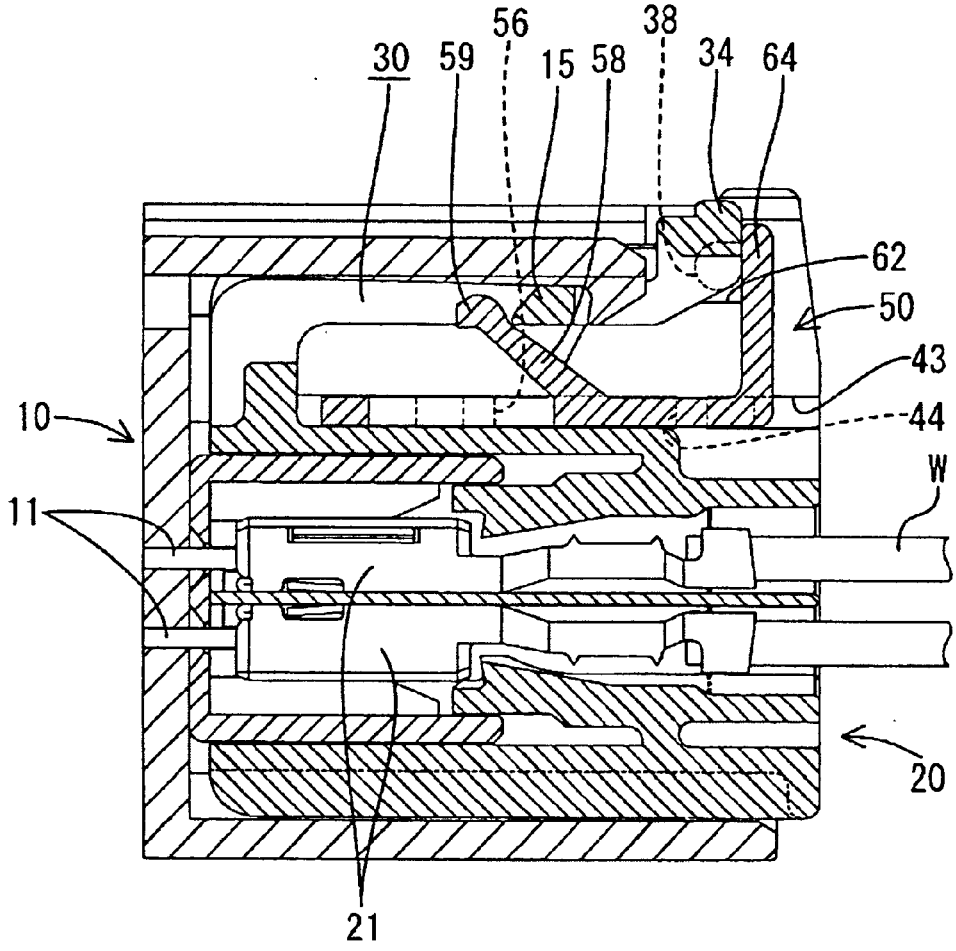
FIG. 9 is a longitudinal section showing a state where the detecting member is pushed to a detecting position.

The head 59 of the resilient locking piece 58 is pressed against the guiding surface 15B of the lock 15 when the detector 50 is pushed in the mounting direction MD, and the resilient locking piece 58 is deformed resiliently along the guiding surface 15B. The detector 50 is pushed in the mounting direction MD while the head 59 passes along the lower surfaces of the lock 15 and the engageable portion 35. The detector 50 is pushed until the upper end of the rear wall 64 contacts the operable portion 34 of the lock arm 30 as shown in FIG. 9, and the head 59 of the resilient locking piece 58 moves beyond the lock 15. Thus, the resilient locking piece 58 is restored to its initial posture and the head 59 engages the lock 15 from behind to lock the detector 50. This position is referred to as a detecting position of the detector 50. Proper connection of the housings 10, 20 is detected based on the ability to move the detector 50 to this detecting position.

The restricting surfaces 62 of the contact walls 60 are below the engaging portions 38 of the lock arm 30 when the detector 50 is pushed in the mounting direction MD to the detecting position. Thus, even if the operable portion 34 is pressed erroneously, the engaging portions 38 contact the restricting surfaces 62, and prevent the operable portion 34 from being pressed. Accordingly the lock arm 30 cannot be inclined inwardly. This advantageously prevents inadvertent unlocking.

Figure 8:
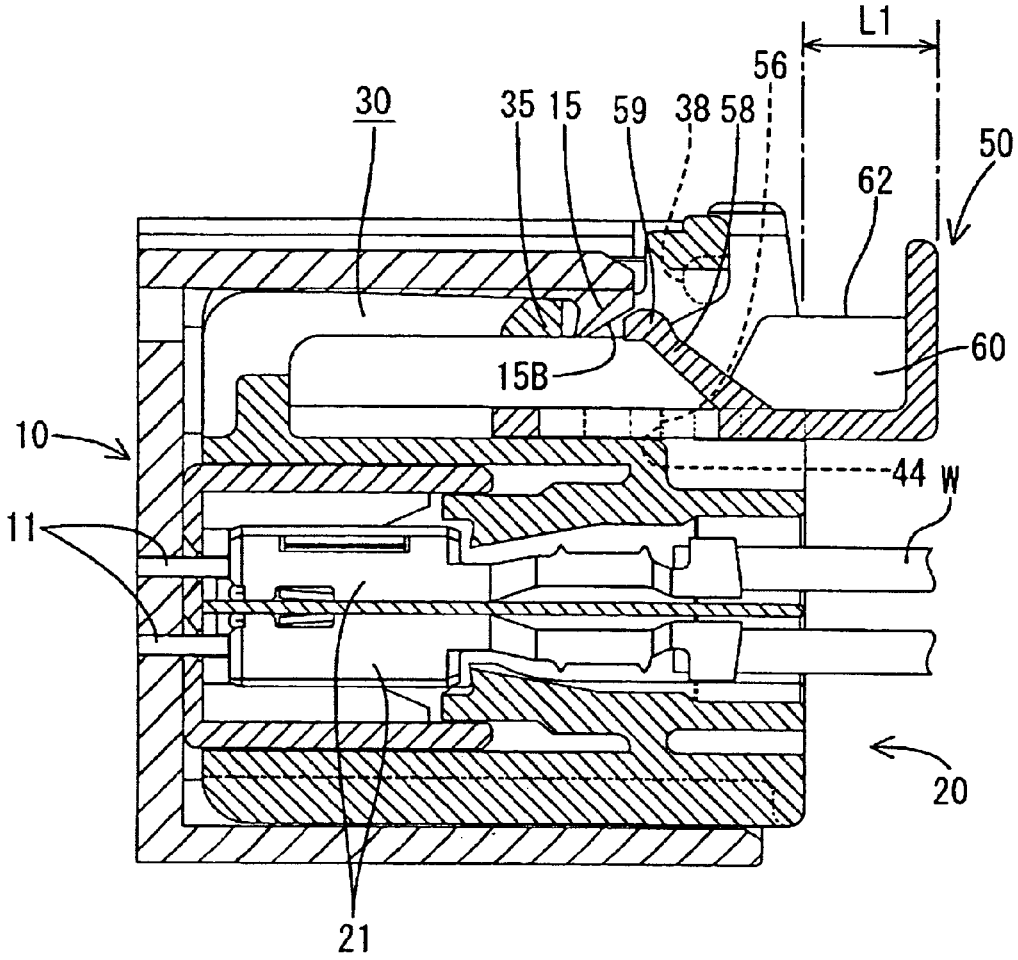
FIG. 8 is a longitudinal section showing a state where the two housings are properly connected with and locked into each other.

The two housings 10, 20 may be separated for maintenance or other reason by inserting a fingernail or jig between the upper end of the rear wall 64 and the operable portion 34 of the lock arm 30 to pull the rear wall 64 back. The upper surface of the head 59 is rounded or substantially semicircular to define a semi-locking construction. The detector 50 is returned in a direction substantially opposite to the mounting direction MD and to the standby position or a position near the standby position, as shown in FIG. 8, while the resilient locking piece 58 is deformed resiliently and passes along the lower surfaces of the lock 15 and the engageable portion 35.

At this time, the restricting surfaces 62 of the contact walls 60 are spaced back from the lower surfaces of the engaging portions 38. Thus, the lock arm 30 can be inclined by pressing the operable portion 34 and the engageable portion 35 disengages from and is located below the lock 15 to allow unlocking. The female housing 20 can be pulled back in a direction opposite the inserting direction ID and separated from the male housing 10.

The detector 50 is detached by inserting the jig through the insertion openings 46 in the front surface of the female housing 20. The left and right frame sections 53A then are deformed inward to disengage the projections 56 from the stopper protrusions 44. Subsequently, the detector 50 may be pulled back in a direction opposite to the mounting direction MD.

As described above, the resilient locking piece 58 of the detector 50 is deformed only when the detector 50 is pushed in the mounting direction MD to detect the connected state of the two housings 10, 20 and does not deform together with the lock arm 30. Thus, the exertion of an excessive load on the base end of the resilient locking piece 58, which serves as a supporting point of deformation, can be avoided. Accordingly, durability can be improved and a connection detecting function can be displayed repeatedly.

The detector 50 is moved back in the direction substantially opposite to the mounting direction MD thereof to the standby position located behind the initial mount position before being pushed in, and then is pushed in from this standby position. Thus, the detector 50 can be pushed toward the detecting position with a larger stroke, making the connection detection more distinct.

A connector of the second embodiment is comprised of a male housing 70 and a female connector housing 80 that are connectable with each other, as shown in FIGS. 10 to 21.

The male housing 70 is made e.g. of a synthetic resin and includes a receptacle 71 substantially in the form of a rectangular tube and the female housing 80 is fittable into the receptacle 71 in an inserting direction ID. Tabs 72*a* at the leading ends of male terminal fittings 72 project forward from the back end surface of the receptacle 71. A lock 73 projects in and down from the opening edge of the upper wall of the receptacle 71. A guiding surface 73*a* is defined at the front surface of the lock 73 and is oblique to a connecting direction ID of the two housings 70, 80. A locking surface 73*b* is defined at the rear surface of the lock 73 and is substantially normal to the connecting direction ID of the two housings 70, 80.

The female housing 80 is made e.g. of a synthetic resin and is substantially in the form of a block that is fittable into the receptacle 71. Female terminal fittings 81 are accommodated in the female housing 80. The tabs 72*a* of the male housing 70 enter the female housing 80 when the 80 is fit into the receptacle 71 in the inserting direction ID, and hence the tabs 72*a* connect with the female terminal fittings 81.

A lock arm 82 is formed unitarily on the upper surface of the female housing 80 for locking the female housing 80 and the male housing 70 in their properly connected state. The lock arm 82 extends up from substantially a widthwise middle portion of the front edge of the upper surface of the female housing 80 and cantilevers back substantially horizontally and parallel to the connecting direction ID of the housings 70, 80. The lock arm 82 is forked to define a groove 83 between two forked sections. An extending end of the lock arm 82 is inclinable into a displacement space 85 with an extending portion 84 thereof at the front end as a supporting point. The forked sections of the lock arm 82 project out at their extending ends, and are coupled to each other by an operable portion 86 that can be used to forcibly incline the lock arm 82.

An engageable portion 87 is formed in the groove 83 near the extending end of the lock arm 82 and bridges the two forked sections. A substantially flat locking surface 87*a* is defined on the engageable portion 87 toward the extending end of the lock arm 82 and is aligned substantially normal to the connecting direction ID of the two housings 70, 80. A slanted guiding surface 87*b* is defined on the opposite surface of the engageable portion 87 and is oblique to the connecting direction ID of the two housings 70, 80. Short cylindrical engaging portions 88 project from the opposite outer surfaces of the operable portion 86 such that their axes extend transversely in directions substantially normal to the connecting direction ID of the two housings 70, 80 and substantially normal to a resiliently deforming direction DD of the lock arm 82.

Left and right protection walls 89 are formed on the upper surface of the female housing 80 at the opposite sides of the lock arm 82. Hook-shaped pressing portions 90 are formed at the upper ends of the rear ends of the respective protection walls 89 and project in from the protection walls 89. The pressing portions restrict upward movement of the engaging portions 88 of the lock arm 82 and prevent the lock arm 82 from being deformed excessively up to a side opposite from the deformation space 85.

Return preventing portions 91 project from inner side surfaces of both protection walls 89 below the pressing portions 90. The inner end surfaces of the return preventing portions 91 are inward from the outer end surfaces of the engaging portions 88 of the lock arm 82. However, the return preventing portions 91 are obliquely down to the back and in a direction opposite the inserting direction ID with respect to the engaging portions 88 when the lock arm 82 is in a free state. Thus, the engaging portions 88 do not interfere with the return preventing portions 91 when the lock arm 82 is deformed resiliently toward the deformation space 85.

A detector 100 is mountable in a mounting direction MD in the female housing 80 for detecting the connected state of the housings 70, 80. A part of the detector 100 is in the deformation space 85 for the lock arm 82 and a space between the two protection walls 89. The detector 100 is made e.g. of a synthetic resin and includes a horizontal plate that extends substantially parallel with the upper surface of the female housing 80 and substantially normal to the mounting direction MD. A contact plate 103 extends obliquely up to the back at a steep inclination close to 90° to the upper surface of the base plate 101 and is slightly narrower than the base plate 101. The contact plate 103 is unitary with the rear end of the base plate 101. A restricting plate 104 has substantially the same width as the contact plate 103 and extends obliquely up to the back at an inclination more moderate than that of the contact plate 103. The restricting plate 104 is coupled to the upper extending edge of the contact plate 103 via an arcuate portion 105, and the upper surface of the restricting plate 104 serves as a restricting surface 104*a*. The base plate 101 has left and right side plates 106 that are continuous with the rear ends of the left and right edges of the base plate 101. The side plates 106 have lower surfaces flush with the lower surface of the base plate 101 and upper edges substantially continuous with the left and right edges of the contact plate 103 and the restricting plate 104. A rear plate 107 extends up from the rear edge of the restricting plate 104 and has substantially the same width as the restricting plate 104.

The detector 100 is movable into and out of the female housing 80 along forward and backward along the mounting direction MD while having the lower surfaces of the base plate 101 and the side plates 106 held substantially in sliding contact with the upper surface of the female housing 80. A foremost position of a movable range of the detector 100 is referred to as a detecting position (see FIG. 16), a rearmost position thereof is referred to as a standby position (see FIGS. 13, 15 and 20), and a position slightly before the standby position is referred to as a push-preventing position (see FIGS. 10, 12, 19).

Projections 108 are formed at the left and right outer ends of the frame-shaped base plate 101, and are insertable into left and right guide grooves 92 formed in the female housing 80 to be substantially parallel with the moving direction MD of the detector 100. Upward and/or transverse loose movements of the detector 100 with respect to the female housing 80 are prevented by the engagement of the projections 108 and the guide grooves,92. With the detector 100 located at the detecting position at the foremost end, the detector 100 is stopped at its front-limit position by having the front end held substantially in contact with the extending-up portion 84 of the lock arm 82. With the detector 100 at the standby position at the rearmost end, the detector 100 is prevented from a backward withdrawal from the guide grooves 92 by the contact of the projections 108 with stoppers 93 of the guide grooves 92.

A resilient locking piece 109 is formed unitarily at a position of the rear edge of the window hole 102 in the base plate 101 while extending obliquely up to the front in the mounting direction MD. The resilient locking piece 109 is at such a position and has such a width as to fit into the groove 83 of the lock arm 82, and a head 110 having the front surface formed into a locking surface 110*a* substantially normal to the moving direction MD of the detector 100 is formed at an extending end of the resilient locking piece 109. The head 110 is at substantially the same height as the groove 83 and the engageable portion 87 when the lock arm 82 is in a free state. Further, a substantially arcuate surface 110*b* is formed from the upper or outer surface of the head 110 over to the rear surface of the rear surface thereof.

Left and right cantilever-shaped deformation preventing pieces 111 are formed on the upper surface of the base plate 101 and extend obliquely up and to the back in a direction substantially opposite to the mounting direction MD from positions slightly before the rear edge of the window hole 102 and close to the left and right edges of the base plate 101. The deformation-preventing pieces 111 are resiliently inclinable down with their base ends (bottom ends) as supporting points. The deformation preventing pieces 111 are provided to extend substantially along the inner side surfaces of the protection walls 89 and to conform to the engaging portions 88 of the lock arm 82 with respect to transverse direction with the detector 100 mounted in the female housing 80. The free ends of the deformation preventing pieces 111 serve as locking ends 112. The locking ends 112 are at substantially same the height as the return-preventing portions 91 of the protection walls 89 in the free state of the detecting member 100 where the deformation preventing pieces 111 are not resiliently deformed, whereas they can slip under the return preventing portions 91 while being displaced obliquely down to the back in a direction substantially opposite to the mounting direction MD when the deformation preventing pieces 111 are deformed downward. When the deformation preventing pieces 111 are resiliently deformed down, the locking ends 112 come substantially into contact from the font with the front surface of the contact plate 103 sloped down to the front and any further resilient deformation of the deformation preventing pieces 111 is prevented by this contact. Further, the front oblique surfaces sloped up to the back or in a direction substantially opposite to the mounting direction MD of the deformation preventing pieces 111 serve as cam surfaces 111*a* which can be brought substantially into contact with the engaging portions 88 of the lock arm 82.

Figure 10:
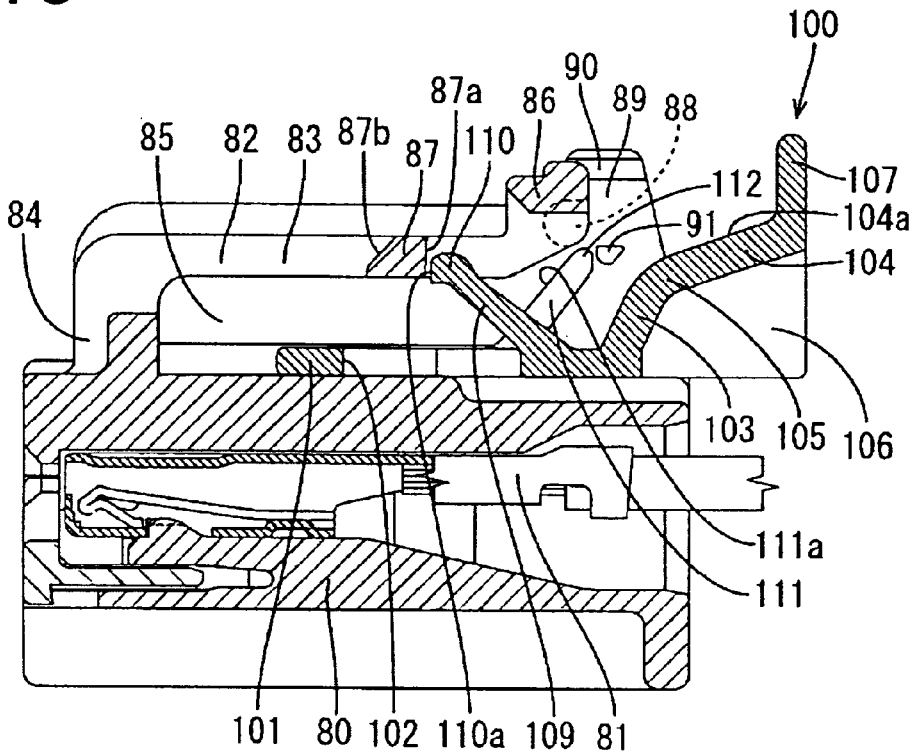
FIG. 10 is a longitudinal section of a female housing according to a second embodiment of the invention.
Figure 11:
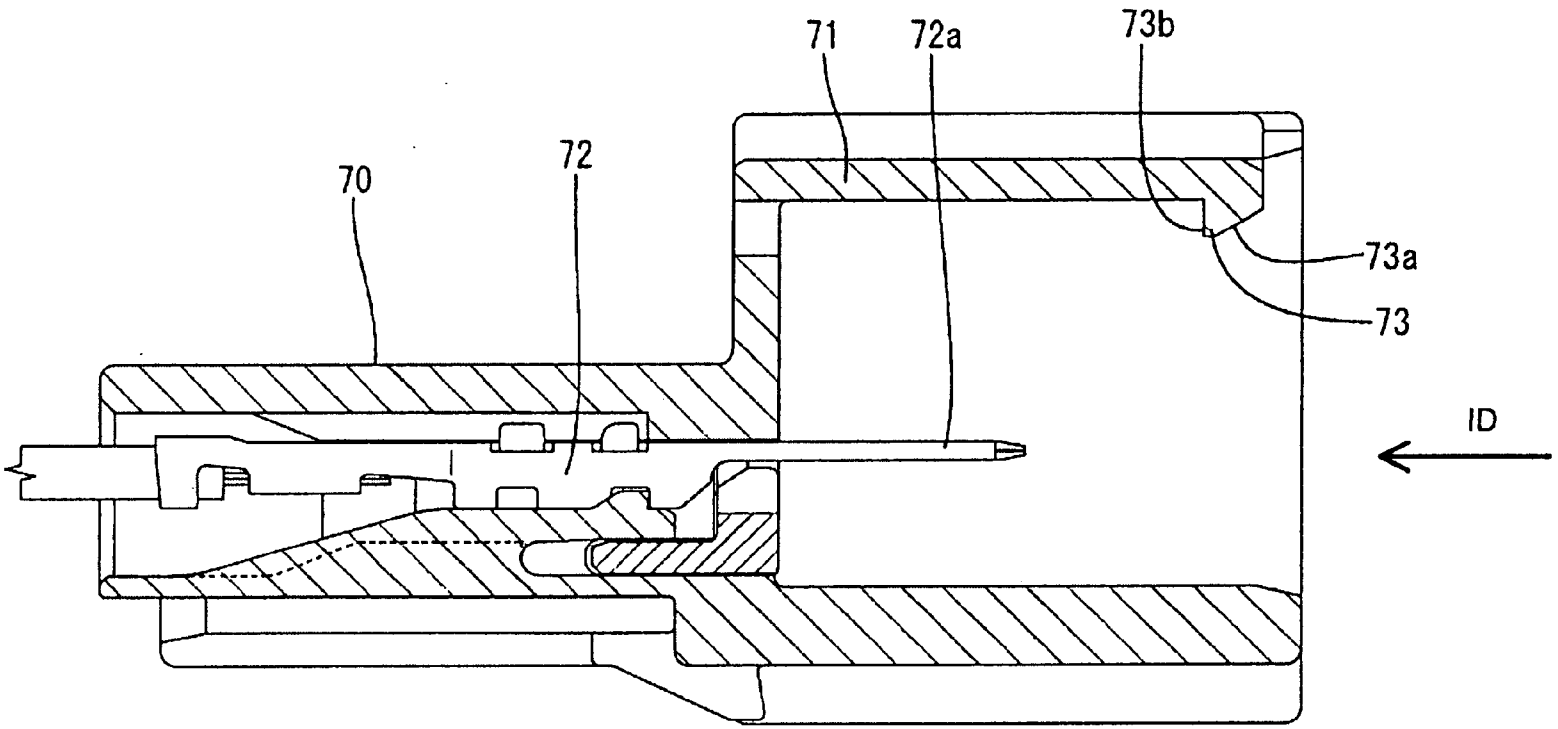
FIG. 11 is a longitudinal section of a male housing.

Prior to the connection of the two housings 70, 80, the male terminal fittings 72 and the female terminal fittings 81 are mounted into the male and female housings 70, 80, respectively, and the detector 100 is mounted in the mounting direction MD into the female housing 80. The detector 100 is pushed into the deformation space 85 in the mounting direction with the left and right projections 108 substantially aligned with the guide grooves 92. During the insertion of the detector 100, the projections 108 pass the stoppers 93 in the guide grooves 92 while portions of the base plate 101 at the left and right sides of the window hole 102 are deformed temporarily inward. The detector 100 is pushed further in the mounting direction MD after the projections 108 pass the stoppers 93, and the locking ends 112 of the deformation preventing pieces 111 contact the return preventing portions 91. Thus, the locking ends 112 slip under the return preventing portions 91 while the deformation preventing pieces 111 are deformed down. As a result, the detector 100 reaches the push-preventing position as shown in FIG. 10.

At the push-preventing position, the locking surface 110*a* of the head 110 of the resilient locking piece 109 contacts the locking surface 87*a* of the engageable portion 87 of the lock arm 82 from behind. Thus, the detector 100 is stopped at its front-limit position and is prevented from forward displacements in the mounting direction MD. Simultaneously, the locking ends 112 of the deformation preventing pieces 111 contact the return preventing portions 91 from the front to lock the detector 100 and to prevent backward displacements. Thus, the detector 100 is held at the push-preventing position and is prevented from shaking in forward and backward directions along the mounting direction MD. At this time, the rear plate 107 and restricting plate 104 of the detector 100 project back from the rear end surface of the female housing 80.

Figure 12:
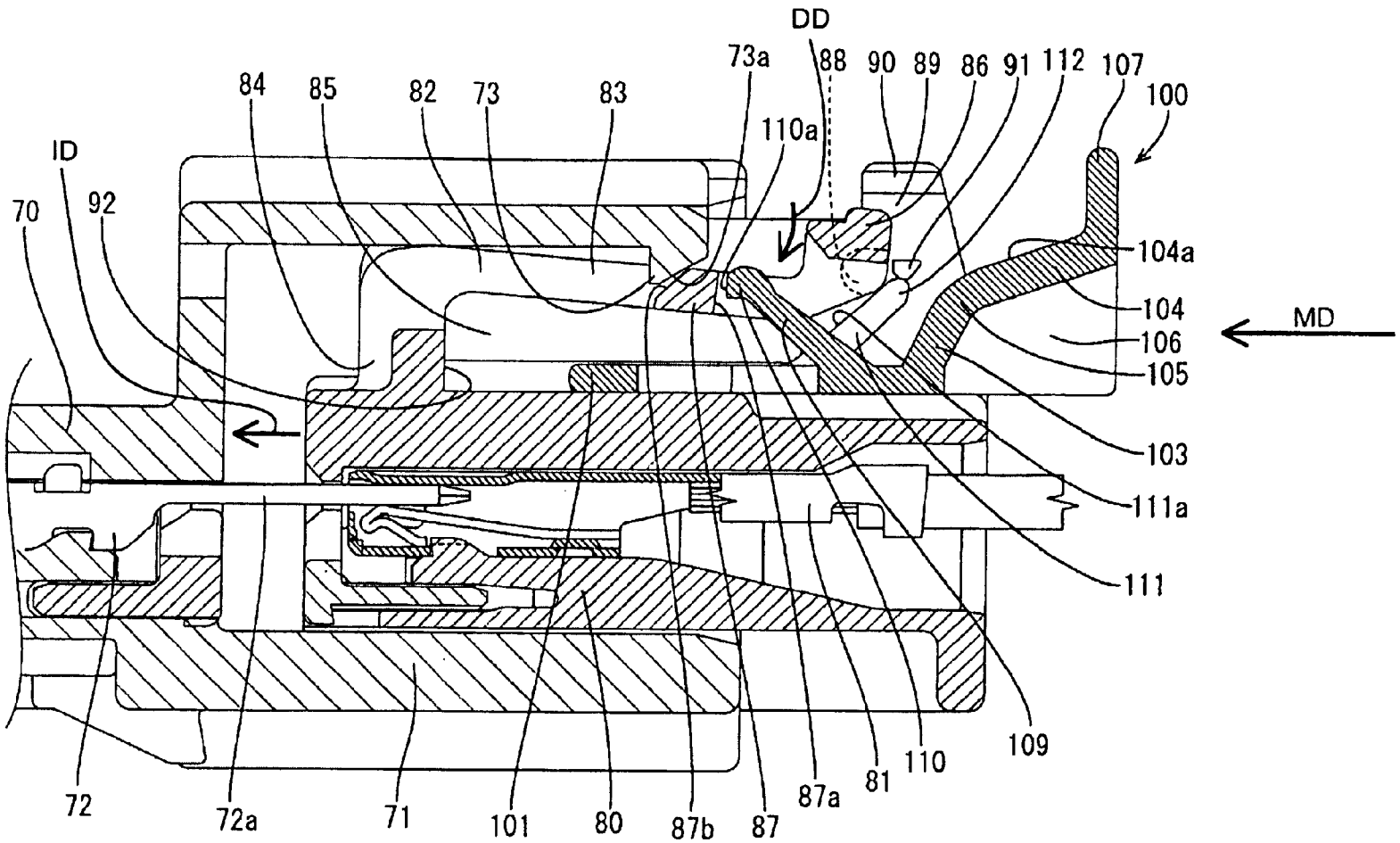
FIG. 12 is a longitudinal section showing an intermediate state of connection of the two housings.

Connection of the housings 70, 80 starts by fitting the female housing 80 in the inserting direction ID into the receptacle 71. In the connecting process, the guiding surface 87*b* of the engageable portion 87 of the lock arm 82 contacts the guiding surface 73*a* of the lock 73, as shown in FIG. 12. Thus, the lock arm 82 is inclined down in the deformation direction DD by the inclinations of the guiding surfaces 87*b*, 73*b* and the engageable portion 87 passes below the lock 73. The inclination of the lock arm 82 in the deformation direction DD causes the engaging portions 88 to press the cam surfaces 111*a* of the deformation preventing pieces 111 obliquely down and to the back in a direction substantially opposite to the inserting direction ID. However, the locking ends 112 of the deformation preventing pieces 111 are prevented from moving backward in a direction opposite to the mounting direction MD by the contact with the return preventing portions 91. Thus, the deformation preventing pieces 111 are pressed by the lock arm 82 while being held in sliding contact with the front surfaces of the return preventing portions 91, and instead of being moved back, the deformation preventing pieces 111 are deformed down in a direction substantially normal to the mounting direction MD. The deformation preventing pieces 111 are deformed down sufficiently to disengage from the return preventing portions 91. This disengagement enables the detector 100 to movable back in a direction substantially opposite to the mounting direction MD with respect to the female housing 80. However, an operator is pushing the detector 100 forward in the inserting direction ID into the female housing 80, and there is no likelihood that the detector 100 will be pulled back by the operator. The head 110 of the resilient locking piece 109 is held opposed to the engageable portion 87 of the lock arm 82 from behind at substantially the same height while the deformation preventing pieces 111 are deformed out of engagement with the return preventing portions 91. Thus, the detector 100 is not relatively moved forward in the mounting direction MD with respect to the female housing 80.

The lock arm 82 inclines sufficiently in the deforming direction DD to disengage the engageable portion 87 of the lock arm 82 from the head 110 of the resilient locking piece 109 as the connection of the housings 70, 80, proceeds. Thus the detector 100 is permitted to make relative forward movements along the moving direction MD. However, during this time, the engaging portions 88 of the lock arm 82 press the cam surfaces 111*a* of the deformation preventing pieces 111 obliquely from the upper-front side and the detector 100 is pushed back in a direction opposite to the mounting direction MD by this pushing force. As a result the detector 100 is moved from the standby position (see FIGS. 13 and 20) located behind the push-preventing position. The projections 108 of the detector 100 are in contact with the stoppers 93 in the guide grooves 92 when the detector 100 is moved back to the standby position. Thus, any further backward movement in a direction opposite to the mounting direction MD of the detector 100 is prevented.

The engaging portions 88 of the lock arm 82 press and resiliently deform the deformation preventing pieces 111. As a result, the locking ends 112 of the deformation preventing pieces 111 deflect down and disengage from the return preventing portions 91. Thus, the deformation preventing pieces 111 and the detector 100 can be moved back in a direction substantially opposite to the mounting direction MD. The deformation preventing pieces 111 deform resiliently up when the locking ends 112 pass behind the return preventing portions 91. Therefore, the locking ends 112 contact the return preventing portions 91 obliquely from the lower-back side. Resilient restoring forces of the deformation preventing pieces 111 act on the return preventing portions 91 at these contact portions, and urge the detector 100 back in a direction opposite to the mounting direction MD.

Figure 13:
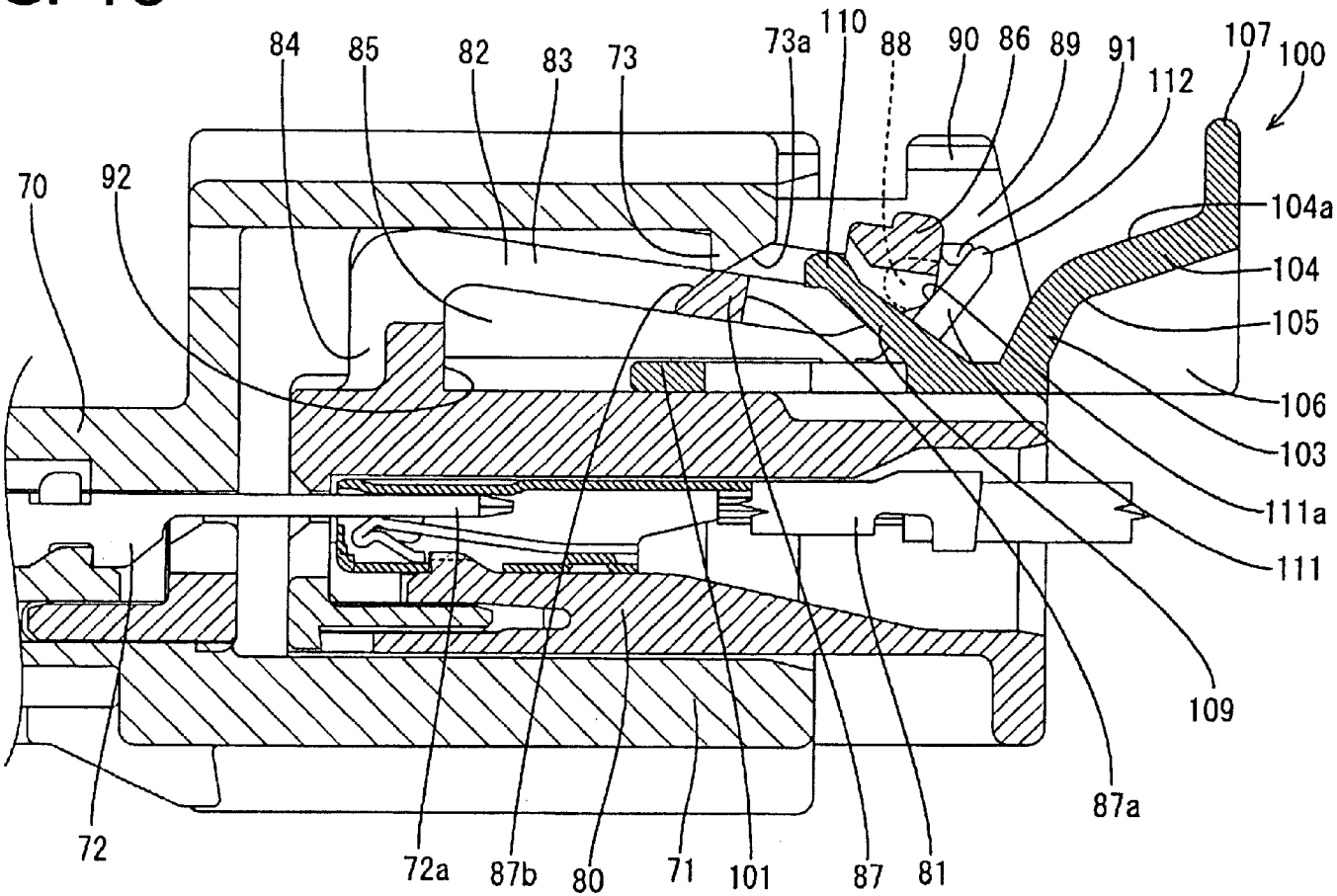
FIG. 13 is a longitudinal section showing a state where a detecting member is moved back from a push-preventing position to a standby position in the process of connecting the two housings.

The two housings 70, 80 are not yet connected properly when the detector 100 reaches the standby position shown in FIG. 13. However, the engageable portion 87 contacts the lock 73 from below to prevent the lock arm 82 from making an upward returning movement in a direction opposite to the deformation direction DD. Additionally, the engaging portions 88 are in contact with the deformation preventing pieces 111 obliquely from the upper-front side. Therefore, the operator cannot push the detector 100 forward in the mounting direction MD if the operator mistakenly leaves the housings 70, 80 in a partly connected condition.

Figure 14:
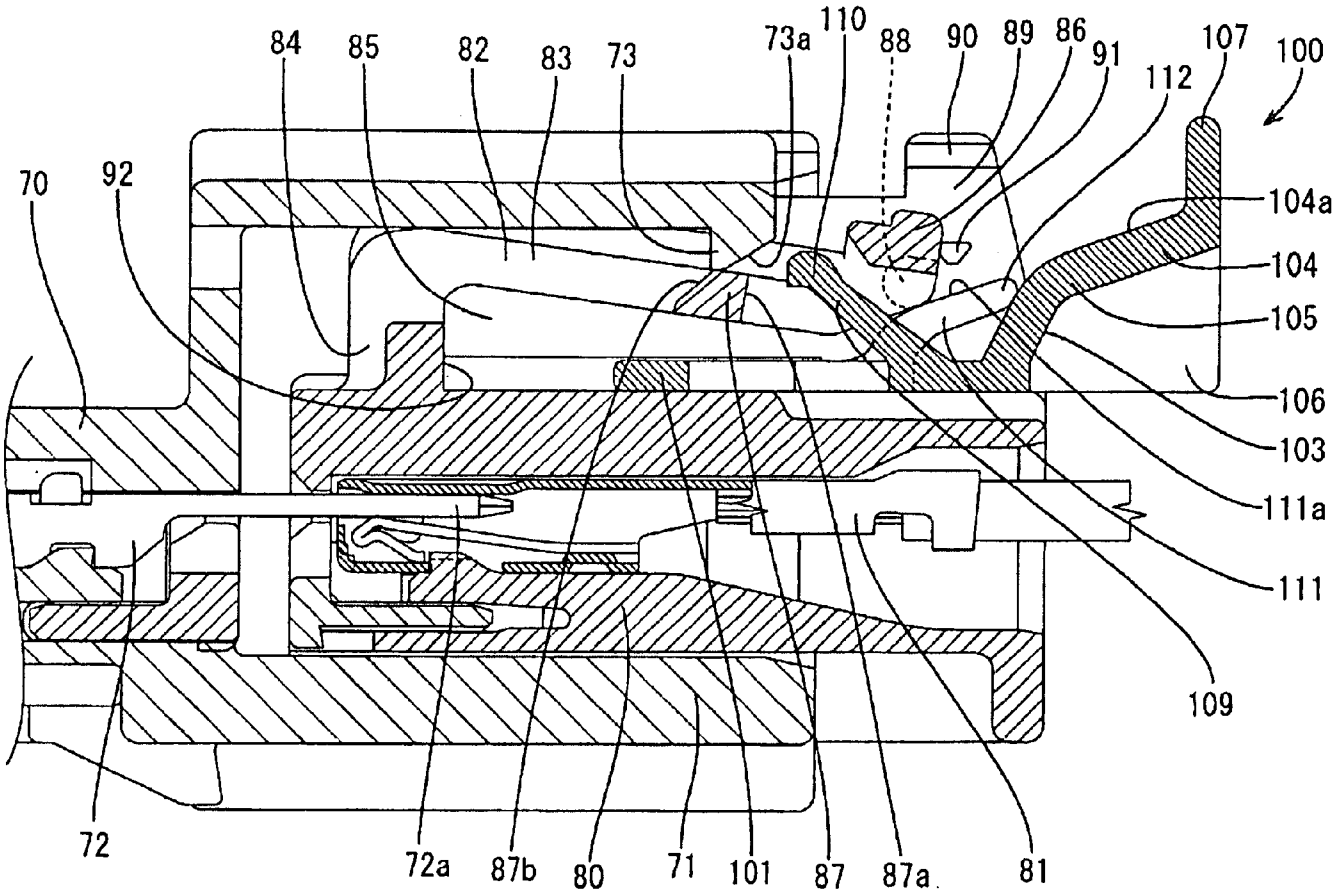
FIG. 14 is a longitudinal section showing a state where the detecting member is pushed in with the two housings left partly connected.

Specifically, the deformation preventing pieces 111 are deformed obliquely down and to the back by the engaging portions 88 of the lock arm 82 and are disengaged from the return preventing portions 91, as shown in FIG. 14. The locking ends 112 contact the contact plate 103 to prevent any further resilient deformation of the deformation preventing pieces 111 immediately after the start of an attempt to push the detector 100. At this time, the rear end of the detector 100 projects a large distance back form the rear end surface of the female housing 80. Accordingly, the deformation preventing pieces 111 and the contact plate 103 abut the engaging portions 88 of the lock arm 82 from behind and prevent the detector 100 from being pushed any further forward. There is no possibility of pushing the detector 100 to the detecting position with the two housings 70, 80 left partly connected, and partial connection of the housings 70, 80 can be detected because the detector 100 cannot be pushed in.

Figure 15:
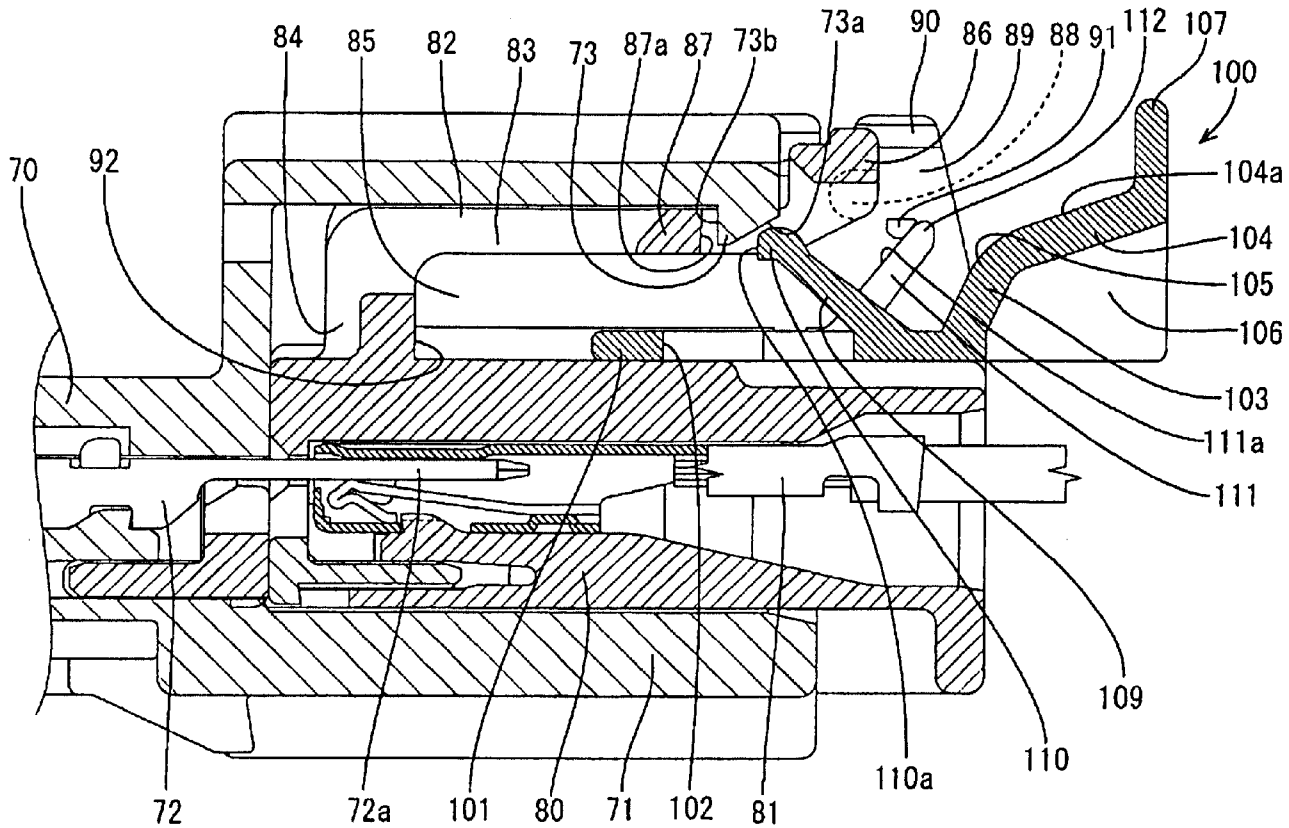
FIG. 15 is a longitudinal section showing a state where the two housings are properly connected.

When the two housings 70, 80 reach their properly connected state, the engageable portion 87 passes the lock 73, as shown in FIG. 15. Thus, the lock arm 82 resiliently returns toward its initial position, and the locking surface 87*a* of the engageable portion 87 engages the locking surface 73*b* of the lock portion 73. In this way, the female housing 80 is prevented from a backward withdrawal in a direction substantially opposite to the inserting direction ID from the receptacle 71 and the two housings 70, 80 are locked in their properly connected state. Further, the detector 100 also moves forward in the mounting direction MD together with the female housing 80, and the head 110 of the resilient locking piece 109 is opposed to the guiding surface 73*a* of the lock portion 73 in proximity and at the substantially same height.

In the process of properly connecting the two housings 70, 80 after the detector 100 is moved back to the standby position, the engaging portions 88 of the lock arm 82 further press the deformation preventing pieces 111 back in a direction substantially opposite to the mounting direction MD. However, the detector 100 is prevented from moving back by the engagement of the projections 108 and the stoppers 93. Therefore, the deformation preventing pieces 111 resiliently deform obliquely down and to the back by being pressed by the lock arm 82. When the two housings 70, 80 are connected properly and the lock arm 82 resiliently returns up in a direction opposite to the deformation direction DD; the deformation preventing pieces 111 are released from their pressed state by the lock arm 82 and resiliently return obliquely up to the front. As a result, the locking ends 112 contact or are opposed to the return preventing portions 91 from behind.

After the two housings 70, 80 are connected properly, as above, the detector 100 can be pushed forward in the mounting direction MD from the standby position to the detecting position for the connection detection. At this time, the head 110 of the resilient locking piece 109 is pressed against the guiding surface 73*a* of the lock 73 and the resilient locking piece 109 is resiliently deformed down by the inclination of the guiding surface 73*a*, and the detector 100 is pushed in the mounting direction MD while the head 110 passes the lower surfaces of the lock 73 and the engageable portion 87. Further, since the locking ends 112 of the deformation preventing pieces 111 contact the return preventing portions 91, the locking ends 112 slip under the return preventing portions 91 to pass them while the deformation preventing pieces 111 are resiliently deformed down by the inclination of the cam surfaces 111*a*. The deformation preventing pieces 111 resiliently return after the locking ends 112 pass the return preventing portions 91.

Figure 16:
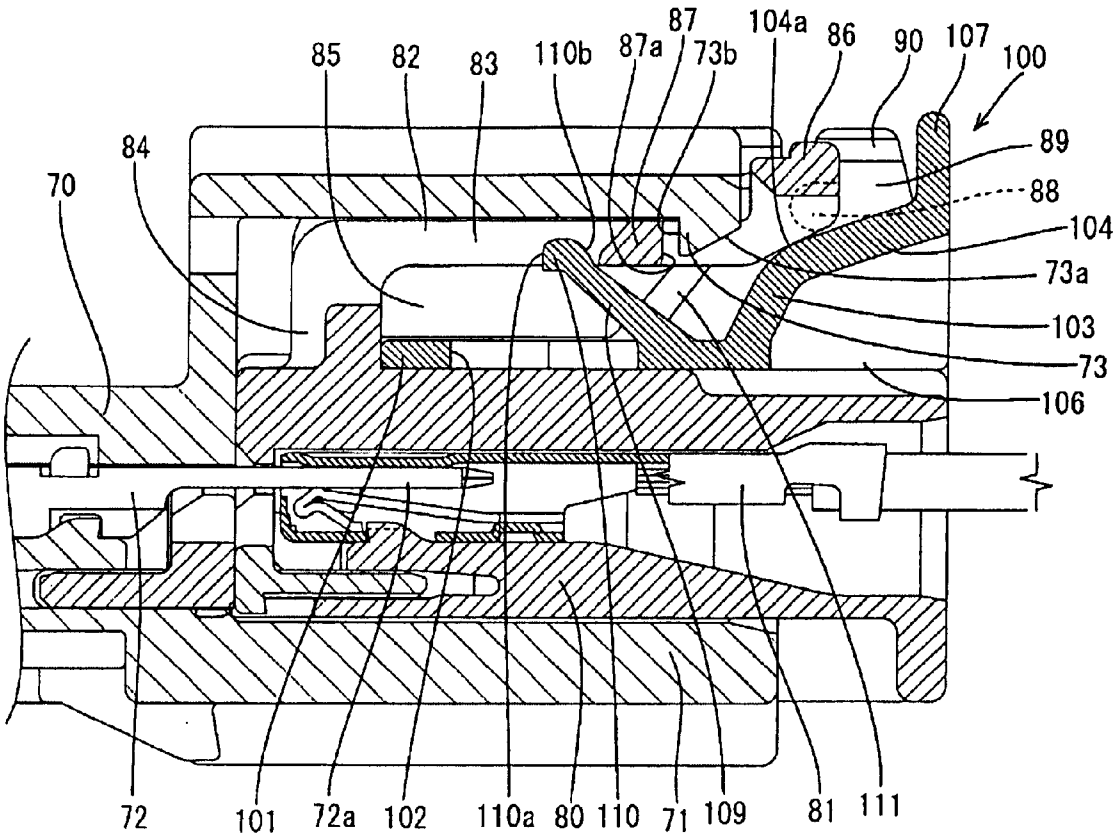
FIG. 16 is a longitudinal section showing a state where the detecting member is pushed from the standby position to a detecting position after the two housings are properly connected.
Figure 17:
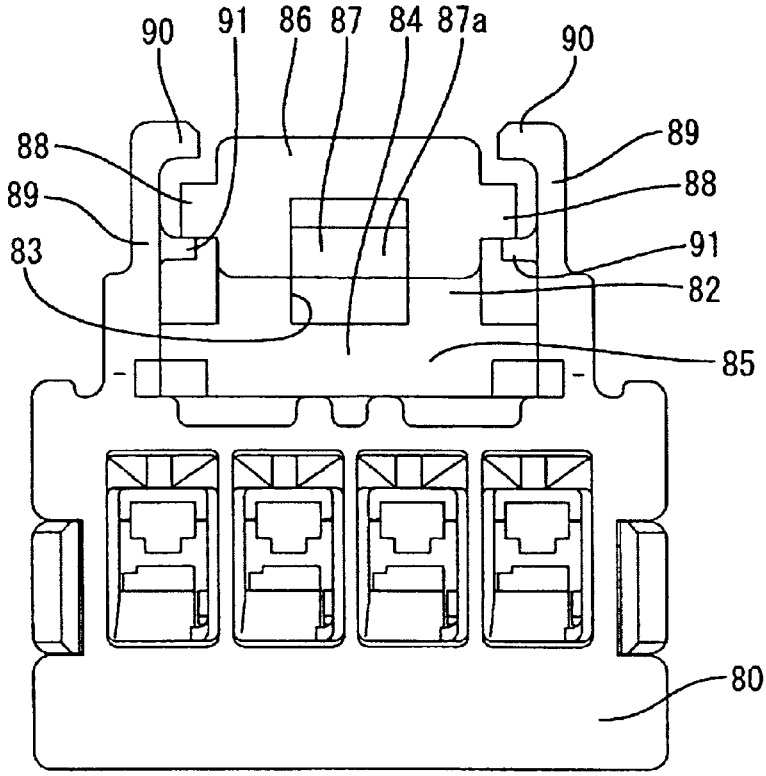
FIG. 17 is a rear view of the female housing with the detecting member detached.
Figure 18:
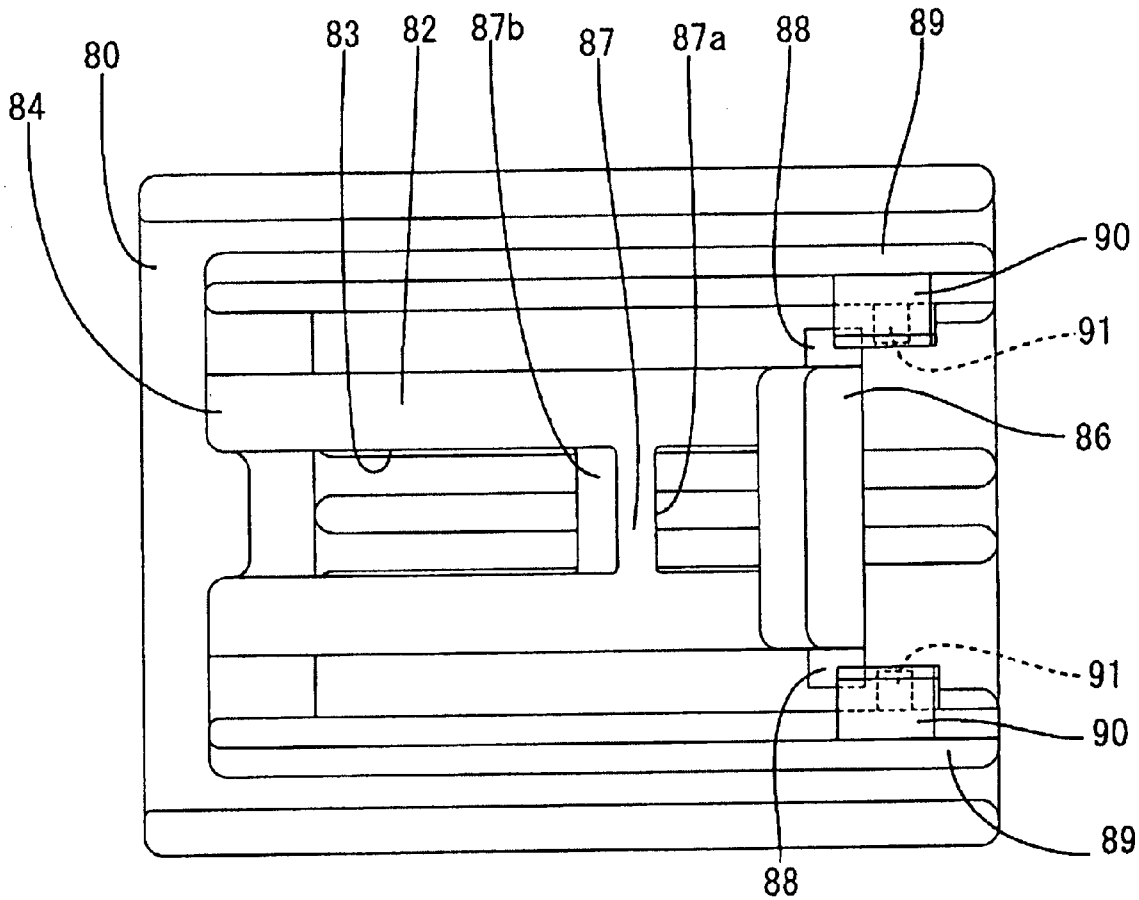
FIG. 18 is a plan view of the female housing with the detecting member detached.
Figure 19:
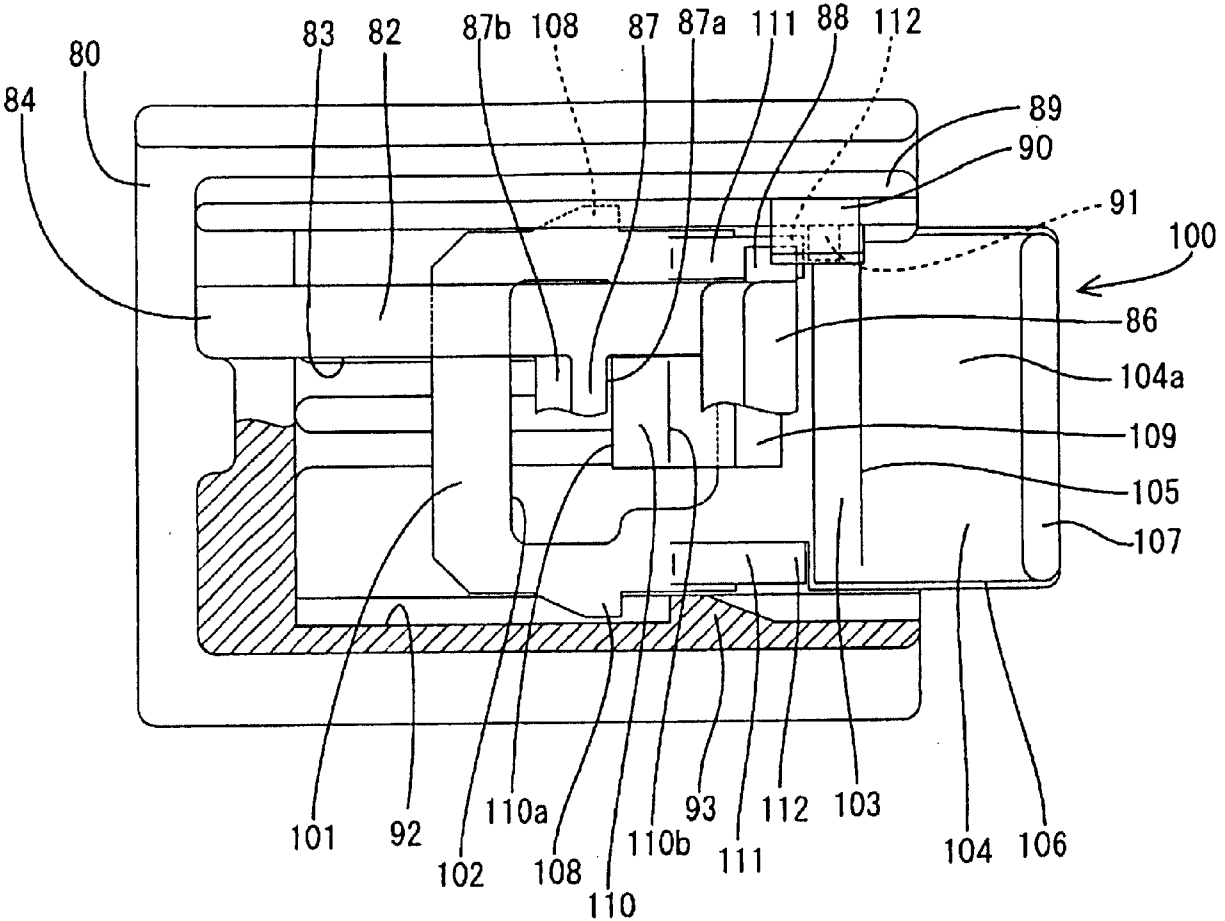
FIG. 19 is a plan view partly in section of the female housing showing a state where the detecting member is located at the push-preventing position.
Figure 20:
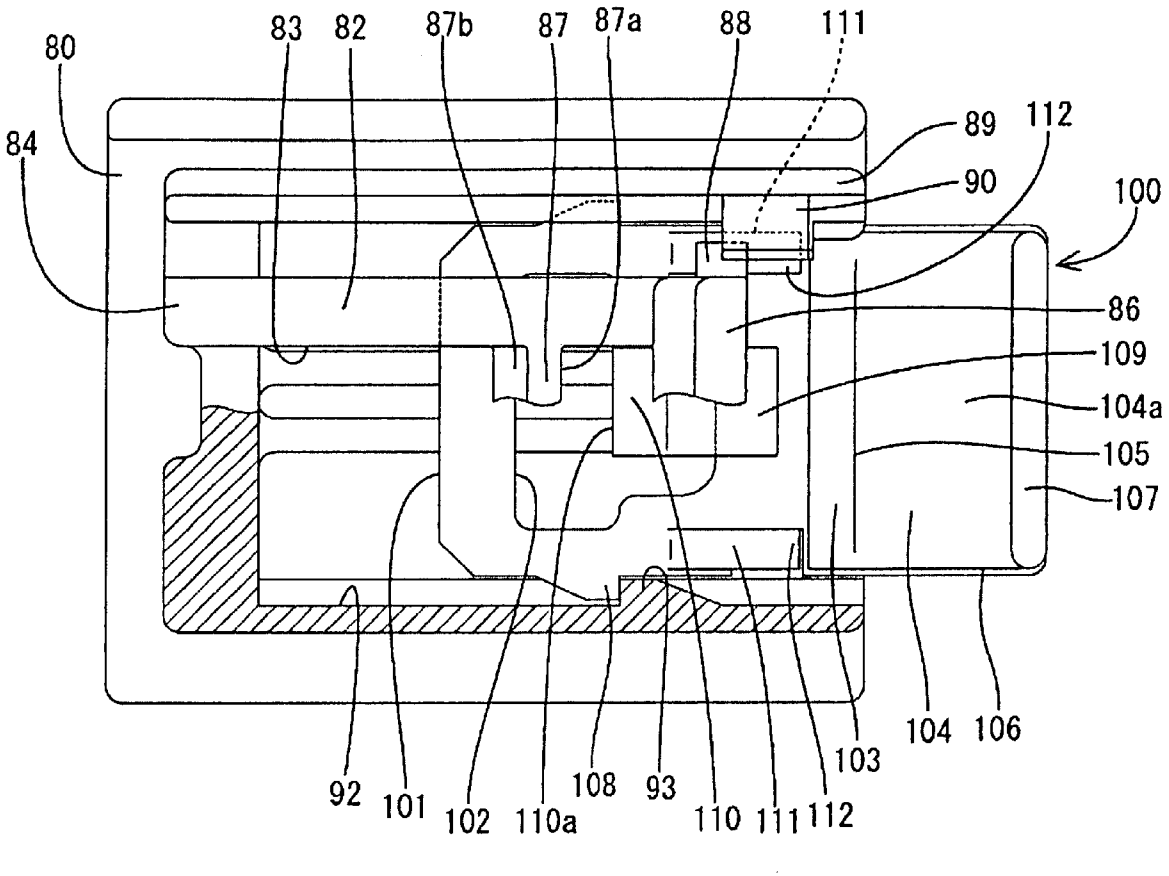
FIG. 20 is a plan view partly in section of the female housing showing a state where the detecting member is located at the standby position.
Figure 21:
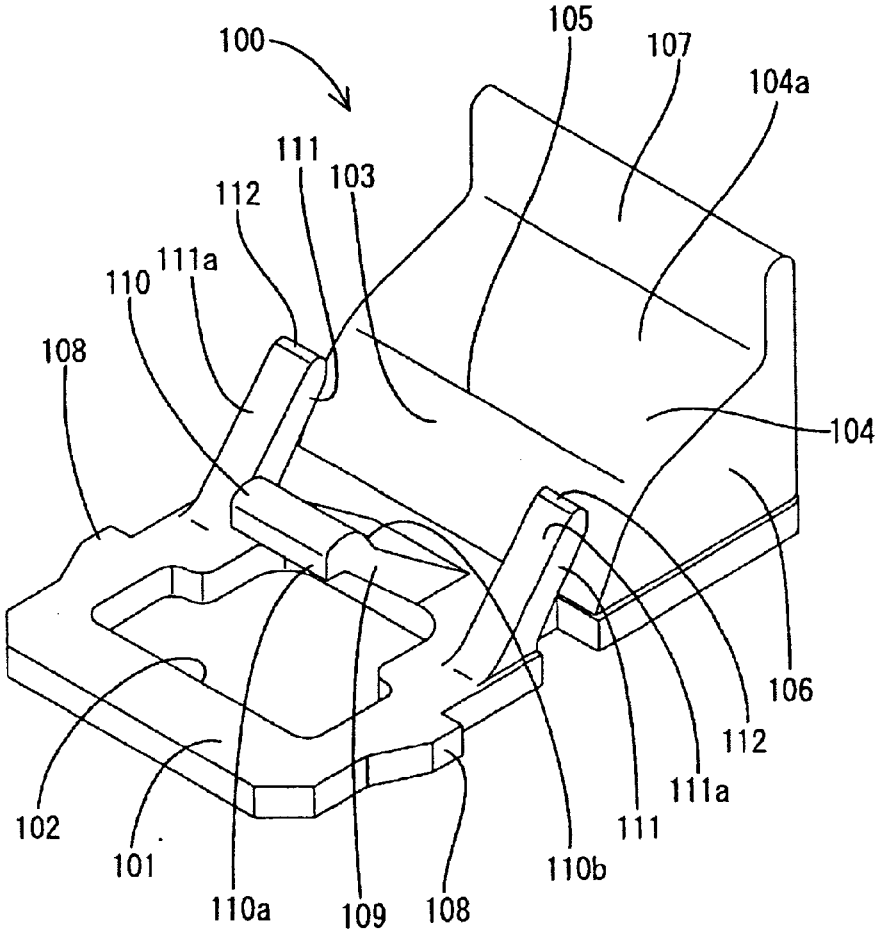
FIG. 21 is a perspective view of the detecting member.
Figure 22A:
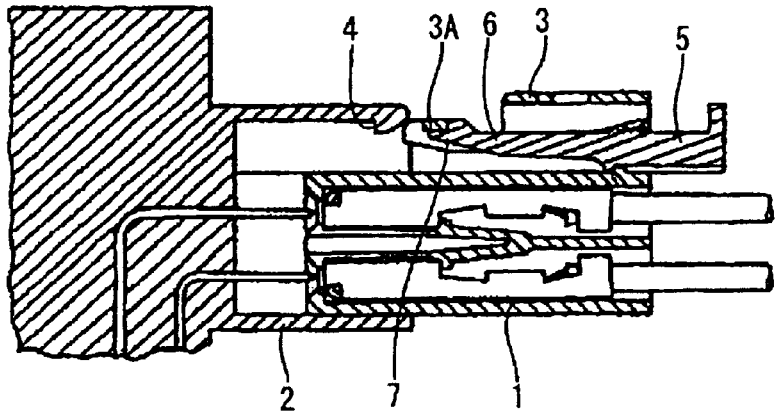
FIG. 22(A) PRIOR ART
FIGS. 22(A) and 22(B) are longitudinal sections of a prior art connector.
Figure 22B:
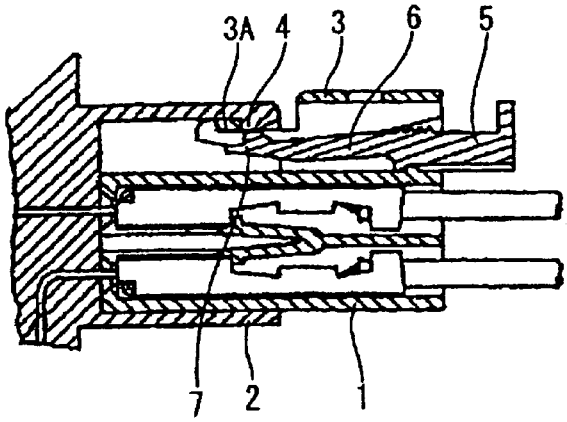
FIG. 22(B) PRIOR ART

Since the head 110 of the resilient locking piece 109 passes the lock portion 73 as shown in FIG. 16 when the detector 100 reaches the detecting position, the resilient locking piece 109 resiliently returns toward or to the initial position to substantially engage the head 110 with the engageable portion 87 from front. This engagement prevents the detector 100 from moving back in the direction substantially opposite to the mounting direction MD with respect to the female housing 80 and the detector 100 is held at the detecting position. The proper connection of the two housings 70, 80 thus can be detected based on whether the detector 100 can be pushed to the detecting position.

With the detector 100 pushed in the mounting direction MD to the detecting position, the rear end surface of the rear plate 107 is substantially flush with the rear end surface of the female housing 80 and the entire detector 100 is in the space between the protection walls 89 and the deformation space 85. Thus, whether the detector 100 has been pushed to the detecting position, i.e. whether the two housings 70, 80 have been connected properly can be detected by the eye.

When the detector 100 is pushed to the detecting position, the left and right ends of the restricting surface 104, which is the upper surface of the restricting plate 104, contact the engaging portions 88 of the lock arm 82 from below. Accordingly, even if an attempt is made to press the operable portion 86 down to inadvertently unlock with the detector 100 left at the detecting position, the engaging portions 88 contact the restricting surfaces 104*a* to prevent the operable portion 86 from being pressed, i.e. prevent the lock arm 82 from being inclined in the deformation direction DD, preferably down in the unlocking direction. This prevents inadvertent unlocking.

The two housings 70, 80 are separated for maintenance or other reason as follows. A fingernail or jig can be inserted between the upper end of the rear plate 107 and the operable portion 86 of the lock arm 82 to pull the rear plate 107 backward. At this time, since the substantially arcuate surface 110*b* is formed from the upper surface of the head 110 over to the rear surface thereof, thereby taking a semi-locking construction, the detector 100 can be returned in the direction substantially opposite to the mounting direction MD to the standby position shown in FIG. 15 while the resilient locking piece 109 is resiliently deformed without any problem and passes the lower surfaces of the lock portion 73 and the engageable portion 87. In this state, the restricting surface 104*a* is disengaged backward from the engaging portions 88, enabling the operable portion 86 to be pressed down. Therefore, the lock arm 82 is inclined in the deformation direction DD to effect unlocking and the two housings 70, 80 may be separated while maintaining this state.

In the process of returning the detector 100, reaction forces from the return preventing portions 91 try to resiliently deform the deformation preventing pieces 111 upward or outward since the locking ends 112 of the deformation preventing pieces 111 press the return preventing portions 91 obliquely from the upper-front side. If the deformation preventing pieces 111 are deformed resiliently up they cannot pass the return preventing portions 91, making it impossible to return the detector 100 to the standby position, and may be damaged. However, since the engaging portions 88 of the lock arm 82 are substantially in contact with the upper or outer surfaces of the locking ends 112 to press them from above or outside or proximately opposed thereto, the deformation preventing pieces 111 are resiliently deformed downward or inwardly to enable the locking ends 112 to pass below the return preventing portions 91 if the operable portion 86 of the lock arm 82 is pressed slightly down in the deformation direction DD. This enables the detecting member 100 to move toward the standby position.

Since the restricting surface 104*a* is a slanted surface sloped down or inwardly to the front or in the mounting direction MD, it can be disengaged from the engaging portions 88 immediately after the detector 100 starts returning. Thus, the operable portion 86 can be pressed down in the deformation direction DD when the locking ends 112 of the deformation preventing pieces 111 contact the return preventing portions 91.

As described above, the resilient locking piece 109 of the detector 100 is deformed only when the detector 100 is pushed in (in the mounting direction MD) to detect the connected state of the two housings 70, 80 or returned and does not undergo a resilient deformation together with the lock arm 82. Thus, the exertion of an excessive load on the base end of the resilient locking piece 109 which serves as a supporting point of deformation can be avoided, with the result that durability can be improved and a connection detecting function can be repeatedly displayed.

Further, the detector 100 is moved back or in the direction substantially opposite to the mounting direction MD to the standby position located behind (as seen in the mounting direction MD) the initial mount position (push-preventing position) before being pushed in, and then pushed in from this standby position. In other words, the initial mount position (or push-preventing position, FIG. 10, 12), the standby position (FIG. 13, 20) and the detecting position (FIG. 16) are arranged preferably in this order in the mounting direction MD. Thus, the detector 100 can be pushed toward the detecting position with a larger stroke, making the connection detection more distinct.

The detector 100 is moved back substantially opposite to the mounting direction MD to the standby position from the push-preventing position where the resilient locking piece 109 and the engageable portion 87 hold the detector 100 while the lock arm 82 is inclined as the two housings 70, 80 are connected. If the detector 100 at the push-preventing position can be moved toward the standby position when the two housings 70, 80 are not yet properly connected, the detector 100 may shake forward and backward. However, the detector 100 at the push-preventing position is prevented from moving toward the standby position by the engagement of the deformation preventing pieces 111 and the return preventing portions 91. Thus, the detector 100 can be securely held at the push-preventing position while being prevented from making loose movements along forward and backward directions.

The deformation preventing pieces 111 are the contact means for preventing the detector 100 from being pushed while the lock arm 82 inclined. However, the deformation preventing pieces 111 are resiliently deformable. Nevertheless, the deformation preventing pieces 111 securely function as the stopper by contacting the contact plate 103 to prevent the resilient deformation.

The restricting surface 104*a* slips under the operable portion 86 of the lock arm 82 when the detector 100 is pushed to the detecting position in the mounting direction MD to lock the lock arm 82 doubly. Therefore, the lock arm 82 cannot be inclined inadvertently to effect unlocking.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

Depending on the shapes of the housings and other factors, the male housing may be provided with the lock arm and the detector.

The present invention is similarly applicable to wire-to-wire connectors, i.e. to connectors used for connecting single wires with each other.

The detector starts being pushed in from the standby position in the foregoing embodiments. However, the detector may start being pushed in the mounting direction MD from the push-preventing position where the resilient locking piece and the engageable portion hold the detector before the standby position without being moved back to the standby position.

Contact of the deformation preventing pieces with the contact portion prevents the detector from being pushed to the standby position in the second embodiments However, the lock arm may be brought directly into contact with the contact portion to prevent the detector from being pushed in.

Although the detector is described as being on the female housing, it may be assembled to the male housing according to the invention.

What is claimed is:

1. A connector, comprising:

first and second housings (20, 10; 80, 70) connectable with each other, the first housing (20; 80) having a lock arm (30; 82) with an engageable portion (35; 87) and the second housing (10; 70) having a lock (15; 73) engageable by the engageable portion (35; 87), the lock arm (30; 82) being deflected as the housings (20, 10; 80, 70) are being connected, and the returning resiliently when the housings (20, 10; 80, 70) are connected properly so that the engageable portion (35; 87) engages the lock (15; 73), and a detector (50; 100) detachably mountable to the first housing (20; 80) for detecting a connected state of the two housings (20, 10; 80, 70) based on whether the detector (50; 100) can be pushed from a standby position (FIG. 8; 15; 20) toward a detecting position (FIG. 9; 16), wherein:

the detector (50; 100) comprises a resilient locking piece (58; 109) opposed to the engageable portion (35; 87) of the lock arm (30; 82) at its initial position before the two housings (20, 10; 80, 70) are connected and at an initial stage of connection of the two housings (20, 10; 80, 70), the resilient locking piece (58; 109) being configured to prevent the detector (50; 100) from being pushed in a mounting direction (MD), and the lock (15; 73) having a guiding surface (15B; 73*a*) opposed to the resilient locking piece (58; 109) when the engageable portion (35; 87) engages the lock (15; 73) and permits the detector (50; 100) to be pushed in the mounting direction (MD) while resiliently deforming the resilient locking piece (58; 109) held in contact therewith when the detector (50; 100) is pushed in the mounting direction (MD).

2. The connector of claim 1, wherein the contact means (38, 60; 103, 111) has a cam surface (61; 111*a*) for engaging the lock arm (30; 82) to move the detector (50; 100) in a direction substantially opposite to the mounting direction (MD) from a push-preventing position (FIG. 10; 12; 19) where the lock arm (30; 82) is held by the resilient locking piece (58; 109) and the engageable portion (35; 87) to the standby position when the lock arm (30; 82) is deformed during the connection of the two connector housings (20, 10; 80, 70).

3. The connector of claim 1, wherein: the first housing (20; 80) has a return preventing portion (91) and the detector (50; 100) is formed with a deformation preventing piece (111); the deformation preventing piece (111) and the return preventing portion (91) contact while the detector (50; 100) is held at the push-preventing position by the resilient locking piece (58; 109) and the engageable portion (35; 87), thereby preventing the detector (50; 100) from moving toward the standby position; and the deformation preventing piece (111) is disengaged from the return preventing portion (91) and is deformed resiliently by the engagement with the lock arm (30; 82) deformed in the process of connecting the two housings (20, 10; 80, 70) so that backward movement of the detector (50; 100) toward the standby position is permitted.

4. The connector of claim 1, wherein the contact means (38; 60; 103, 111) comprises a deformation preventing piece (111) and a contact portion (60; 103) formed on the first housing (20; 80) and, when the detector (50; 100) is pushed in a partly connected state of the two housings (20, 10; 80, 70) where the lock arm (30; 82) is deformed, the deformation preventing piece (111) pushed by the lock arm (30; 82) comes substantially into contact with the contact portion (60; 103) to be prevented from undergoing a resilient deformation, thereby preventing the detector (50; 100) from being pushed.

5. The connector of claim 1, wherein the detector (50; 100) is formed with a restricting surface (62; 104*a*) for slipping under an operable portion (34; 86) used to deform the lock arm (30; 82), thereby substantially preventing the lock arm (30; 82) from being deformed when the detector (50; 100) is pushed to the detecting position.

6. The connector of claim 1, wherein a lock arm contact portions (62; 91) are provided for preventing the lock arm (30; 82) from being deflected, when the detector (50; 100) is substantially in the detecting position.

7. The connector of claim 1, wherein the detector (50; 100) has a semi-locking construction (59; 110) for allowing the detector (50; 100) to be returned in a direction substantially opposite to the mounting direction (MD) to the standby position when a force larger than a specified force is applied thereto.

8. The connector of claim 1, wherein loose movement restricting means(43, 56; 92, 108) are provided for restricting upward and/or transverse loose movements of the detecting member (50; 100) with respect to the first housing (20; 80).

9. The connector of claim 1, wherein when the detector (50; 100) is pushed in the mounting direction (MD) to the detecting position, the rear end surface thereof is substantially flush with the rear end surface of the female housing (20; 80).

* * * * *